US009630759B2

(12) United States Patent
Kuge et al.

(10) Patent No.: US 9,630,759 B2
(45) Date of Patent: Apr. 25, 2017

(54) GUSSET BAG, SPOUT-ATTACHED GUSSET BAG, AND METHOD OF MANUFACTURING THE SAME

(75) Inventors: Raizo Kuge, Hanno (JP); Kazuhiro Umenaka, Fujimino (JP); Akira Ishii, Hanno (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 915 days.

(21) Appl. No.: 13/392,438

(22) PCT Filed: Aug. 26, 2010

(86) PCT No.: PCT/JP2010/064501

§ 371 (c)(1),
(2), (4) Date: Feb. 24, 2012

(87) PCT Pub. No.: WO2011/024906

PCT Pub. Date: Mar. 3, 2011

(65) Prior Publication Data

US 2012/0170876 A1 Jul. 5, 2012

(30) Foreign Application Priority Data

Aug. 26, 2009 (JP) ..... 2009-195613
Dec. 24, 2009 (JP) ..... 2009-292065
Aug. 25, 2010 (JP) ..... 2010-188480

(51) Int. Cl.
*B65D 30/10* (2006.01)
*B65D 30/20* (2006.01)
(Continued)

(52) U.S. Cl.
CPC ..... *B65D 75/008* (2013.01); *B31B 37/00* (2013.01); *B65D 31/10* (2013.01);
(Continued)

(58) Field of Classification Search
CPC ..... B65D 35/10; B65D 47/06; B65D 75/008; B65D 75/5861; B65D 75/5872;
(Continued)

(56) References Cited

U.S. PATENT DOCUMENTS 1,107,347 A * 8/1914 Powers ..... 229/400
3,394,871 A * 7/1968 Williams et al. ..... 383/44
(Continued)

FOREIGN PATENT DOCUMENTS

CN 1149027 A 5/1997
GB 2092990 A * 8/1982 ..... B65D 88/22
(Continued)

OTHER PUBLICATIONS

JP,10-157743, Jun. 16, 1998.*
(Continued)

*Primary Examiner* — Jes F Pascua
*Assistant Examiner* — Nina Attel
(74) *Attorney, Agent, or Firm* — Sughrue Mion, PLLC

(57) ABSTRACT

A gusset bag (10), having a pair of flat surface portions (11, 11) facing each other and a pair of side surface portions (12, 12) facing each other which are folded toward the inside, has a side edge sealing portion (13) in which the flat surface portion and the side surface portion are heat-sealed together at side edge portions thereof, and a folded-back portion (13*c*) in which all or a part of the side edge sealing portion in the width direction is folded back toward the flat surface portion or the side surface portion. The gusset bag and a spout-attached gusset bag (1) using the gusset bag have an excellent self-standing property, and causes one's hand to feel little pain even when being squeezed.

7 Claims, 14 Drawing Sheets

(51) Int. Cl.
*B65D 75/00* (2006.01)
*B31B 37/00* (2006.01)
*B65D 75/58* (2006.01)

(52) U.S. Cl.
CPC ..... *B65D 75/5883* (2013.01); *B31B 2237/20* (2013.01); *B31B 2237/50* (2013.01)

(58) Field of Classification Search
CPC ..... B65D 75/5877; B65D 75/5883; B65D 77/065; B65D 77/068; B65D 2547/06; B65D 2547/063; B65D 25/40; B65D 25/42; B65D 31/10; B65D 31/16; B65D 33/02; B65D 75/26; B65D 75/28; B65D 75/30; B65D 75/305; B31B 19/60; B31B 19/64; B31B 19/66; B31B 19/26; B31B 19/36; B31B 19/52; B31B 2219/26; B31B 2219/2681; B31B 2219/269; B31B 25/00; B31B 2221/50; B31B 2237/50; B31B 29/00; B31B 29/60; B31B 1/60; B31B 1/62; B31B 1/64; B31B 1/66; B31B 1/68; B31B 1/70; B31B 1/72
USPC .... 222/92, 105–107; 383/80, 104, 105, 107, 383/108, 119, 120
See application file for complete search history.

(56) References Cited

U.S. PATENT DOCUMENTS

| | | | | | |
|---|---|---|---|---|---|
| 3,462,070 | A | * | 8/1969 | Corella | 206/219 |
| 3,851,814 | A | * | 12/1974 | Stage | 383/94 |
| 3,868,056 | A | * | 2/1975 | Keren | 206/521 |
| 5,114,393 | A | * | 5/1992 | Vettorato | 493/193 |
| 5,944,251 | A | * | 8/1999 | LaFleur | 229/117.35 |
| 2003/0012851 | A1 | * | 1/2003 | Kuge et al. | 426/85 |

FOREIGN PATENT DOCUMENTS

| | | | | | |
|---|---|---|---|---|---|
| JP | 51-90675 | A | | 8/1976 | |
| JP | 58088306 | U | | 6/1983 | |
| JP | 10-157743 | A | | 6/1998 | |
| JP | 10-316149 | A | | 12/1998 | |
| JP | 10-316150 | A | | 12/1998 | |
| JP | 11058563 | A | | 3/1999 | |
| JP | 11-147547 | A | | 6/1999 | |
| JP | 2000033953 | A | | 2/2000 | |
| JP | 2000-72161 | A | | 3/2000 | |
| JP | 2000-335596 | A | | 12/2000 | |
| JP | 2001-301769 | A | | 10/2001 | |
| JP | 2001270533 | A | * | 10/2001 | |
| JP | 2002-210844 | A | | 7/2002 | |
| JP | 2003-160143 | A | | 6/2003 | |
| JP | 2003261150 | A | | 9/2003 | |
| JP | 2014-196414 | A | | 7/2004 | |
| JP | 2004-359333 | A | | 12/2004 | |
| JP | 2005059928 | A | * | 3/2005 | |
| JP | 2005-263300 | A | | 9/2005 | |
| JP | 2005-271462 | A | | 10/2005 | |
| JP | 2005-306426 | A | | 11/2005 | |
| JP | 2005324844 | A | | 11/2005 | |
| JP | WO 2008001829 | A1 | * | 1/2008 | B65D 75/008 |
| JP | 2009057056 | A | * | 3/2009 | |
| JP | 2009154923 | A | | 7/2009 | |

OTHER PUBLICATIONS

Chinese Office Action corresponding to Chinese Patent Application No. 201080037231.X, dated Apr. 17, 2013.
International Search Report for PCT/JP2010/064501 filed Nov. 2, 2010.
Communication dated Nov. 24, 2015 from the Japanese Patent Office issued in corresponding Japanese application No. 2014-096401.
Communication dated Jun. 16, 2015 from the Japanese Patent Office in counterpart application No. 2014-096401.
Communication dated Dec. 20, 2016, issued by the Japan Patent Office in corresponding Japanese Application No. 2016-009892.
Communication dated Nov. 22, 2016, issued by the Japan Patent Office in corresponding Japanese Application No. 2016-009893.

* cited by examiner

GUSSET BAG, SPOUT-ATTACHED GUSSET BAG, AND METHOD OF MANUFACTURING THE SAME

CROSS REFERENCE TO RELATED APPLICATIONS

This application is a National Stage of International Application No. PCT/JP2010/064501, filed on Aug. 26, 2010, which claims priority from Japanese Patent Application Nos. 2009-195613, filed on Aug. 26, 2009, 2009-292065, filed on Dec. 24, 2009, and 2010-188480, filed on Aug. 25, 2010, the contents of all of which are incorporated herein by reference in their entirety.

TECHNICAL FIELD

The present invention relates to a gusset bag, a spout-attached gusset bag, and a method of manufacturing the gusset bag and the spout-attached gusset bag.

Priority is claimed on Japanese Patent Application No. 2009-195613, filed Aug. 26, 2009, Japanese Patent Application No. 2009-292065, filed Dec. 24, 2009, and Japanese Patent Application No. 2010-188480, filed Aug. 25, 2010, the contents of which are incorporated herein by reference.

BACKGROUND ART

Standing pouches and flat bottom-type gusset bags are used as package bags for liquid or semi-liquid contents such as a jelly drink. These package bags are contrived to secure a self-standing property. Particularly, in the case of package bags for a jelly drink or the like, there is a wide use of gusset bags which can easily stand independently by the weight of the contents and are squeezed by one's hand to easily push out the contents.

As a specific example of the gusset bag, for example, a spout-attached gusset bag (for example, Patent documents 1 and 2) is known in which edge portions of a laminate film having a heat-sealable film adhered to one side thereof are heat-sealed together for the laminate film to have a cylindrical shape, the laminate film is gusset-folded so that the heat-sealed portion is positioned on the rear surface or the side surface, and an upper edge portion and a lower edge portion are heat-sealed for the laminate film to have a bag shape with a spout liquid-tightly attached to the upper edge portion. However, when the spout-attached gusset bag contains contents, the body portion swells, whereby the appearance may deteriorate.

Meanwhile, as shown in FIGS. 21A and 21B, a spout-attached gusset bag 101 (for example, Patent document 3) is known which is provided with a gusset bag 110 which is formed of a pair of flat surface portions 111, 111 facing each other and a pair of side surface portions 112, 112 connecting the side edges of both of the flat surface portions 111, 111 to each other so as to be folded toward the inside of the gusset bag 110, and a spout 120 which is attached to the gusset bag 110 to discharge the contents from the gusset bag 110.

In the spout-attached gusset bag 101, the side edge portion of the flat surface portion 111 and the side edge portion of the side surface portion 112 are heat-sealed together, and thus a side edge sealing portion 113 is formed. The side edge sealing portion 113 of the spout-attached gusset bag 101 has high rigidity because the flat surface portion 111 and the side surface portion 112 are heat-sealed together. This portion functions as a support, and thus the self-standing property of the spout-attached gusset bag 101 is improved. In addition, due to the side edge sealing portion 113 functioning as a support, the swelling of the body portion when containing contents is also suppressed.

DOCUMENTS OF THE PRIOR ART

Patent Document

[Patent document 1] Japanese Patent Application, First Publication No. H11-147547

[Patent document 2] Japanese Patent Application, First Publication No. 2000-72161

[Patent document 3] Japanese Patent Application, First Publication No. 2004-196414

DISCLOSURE OF THE INVENTION

Problems to be Solved by the Invention

However, since the spout-attached gusset bag 101 has the side edge sealing portion 113, one's hand may feel pain when strongly squeezing the bag. That is, the side edge sealing portion 113 projects in the outward direction of the gusset bag 110 and has high rigidity, and an end 113*a* thereof is comparatively sharp. Therefore, one's hand may feel pain because the end 113*a* is embedded in the hand when squeezing the bag. Particularly, in the case in which the contents are a jelly drink or the like, in general, the gusset bag 110 is squeezed by one's hand to push out the contents when drinking the contents. Accordingly, it is desired to cause one's hand to feel little pain even when squeezing the gusset bag 110.

As a method to cause one's hand to feel little pain when squeezing the bag, there is a method of not forming the side edge sealing portion 113 by using a cylindrical gusset bag in which all of the flat surface portions 111, 111 and the side surface portions 112, 112 are formed integrally with each other. However, in this method, since the side edge sealing portion 113 functioning as a support is not present, the self-standing property of the gusset bag deteriorates.

An object of the invention is to provide a gusset bag which has an excellent self-standing property and causes one's hand to feel little pain even when being squeezed, and a spout-attached gusset bag having a spout attached to the gusset bag.

In addition, an object of the invention is to provide a method of manufacturing a gusset bag which has an excellent self-standing property and causes one's hand to feel little pain even when being squeezed, and a method of manufacturing a spout-attached gusset bag having a spout attached to the gusset bag.

Means for Solving the Problem

The invention employs the following configurations to solve the problem.

[1] A gusset bag including: a pair of flat surface portions facing each other; and a pair of side surface portions facing each other which are folded toward the inside thereof, has a side edge sealing portion in which the flat surface portion and the side surface portion are heat-sealed together at side edge portions thereof, and a folded-back portion in which all or a part of the side edge sealing portion in a width direction thereof is folded back toward the flat surface portion or the side surface portion.

[2] The gusset bag according to [1], in which one flat surface portion and the pair of side surface portions are formed of one film member, and side edge portions of each of the side surface portions formed of the film member and side edge portions of the other flat surface portion are heat-sealed together to form the two side edge sealing portions.

[3] The gusset bag according to [1] or [2], in which the entire side edge sealing portion is folded back toward the flat surface portion or the side surface portion.

[4] The gusset bag according to any one of [1] to [3], in which the side edge sealing portion has an unsealed portion which is not heat-sealed along the vertical direction and which is located in the middle of the side edge sealing portion in the width direction, and the gusset bag has the folded-back portion in which the side edge sealing portion is folded back toward the flat surface portion or the side surface portion along the unsealed portion.

[5] The gusset bag according to any one of [1] to [4], in which the pair of flat surface portions and the pair of side surface portions have no folded-back portion at upper end portions thereof.

[6] A spout-attached gusset bag in which a spout is attached to an opening portion of the gusset bag according to any one of [1] to [5].

[7] A method of continuously manufacturing the gusset bag according to [2], which is a method of manufacturing a gusset bag including the following steps of (α1) to (α4).

(aα1) a step of conveying a long film member (A) which forms one flat surface portion and a pair of side surface portions with a long film member (B) which forms the other flat surface portion in a state in which the long film member (A) is folded so that a plurality of the one flat surface portion and the pair of side surface portions are formed in parallel to each other along a longitudinal direction, to heat-seal a portion between the neighboring side surface portions of the film member (A) to the film member (B) along the longitudinal direction and heat-seal each of the portions at the side ends from the side surface portions positioned at both ends of the film member (A) to the film member (B) along the longitudinal direction.

(α2) a step of cutting a heat-sealing portion of the film members (A) and (B) along the longitudinal direction to obtain a plurality of cylindrical film members having the flat surface portions and the side surface portions in which the two side edge sealing portions are formed.

(α3) a step of folding back all or a part of the side edge sealing portion in the width direction toward the flat surface portion or the side surface portion.

(α4) a step of heat-sealing and cutting the cylindrical film member along a direction perpendicular to the longitudinal direction to divide the cylindrical film member into a plurality of pieces in the longitudinal direction.

[8] A method of continuously manufacturing the gusset bag according to [1], which is a method of manufacturing a gusset bag including the following steps of (β1) to (β4).

(β1) a step of conveying two long film members (C) which form the flat surface portions and a plurality of long film members (D) which are center-folded along a longitudinal direction and form the side surface portions so that the plurality of center-folded film members (D) are in parallel to each other between the two film members (C), the fold lines of the center-folded film members (D) positioned at both ends are directed to an inside, and the fold lines of the film members (D) parallel to each other are alternately directed to right and left, to heat-seal the respective side edge portions of each of the film members (D) to each of the two film members (C) along the longitudinal direction.

(β2) a step of cutting the heat-sealed film members (C) and (D) between the side edge portions, facing each other, of the two film members (D) along the longitudinal direction to obtain a plurality of cylindrical film members having the flat surface portions and the side surface portions in which the four side edge sealing portions are formed.

(β3) a step of folding back all or a part of the side edge sealing portion in the width direction toward the flat surface portion or the side surface portion.

(β4) a step of heat-sealing and cutting the cylindrical film member along the direction perpendicular to the longitudinal direction to divide the cylindrical film member into a plurality of pieces in the longitudinal direction.

[9] A method of manufacturing a spout-attached gusset bag using the method of manufacturing the gusset bag according to [7] or [8], in which a spout is attached when an upper portion of one of the plurality of pieces into which the cylindrical film member is divided in the longitudinal direction is sealed.

Effects of the Invention

A gusset bag and a spout-attached gusset bag of the invention have an excellent self-standing property, and even when squeezing the bag by one's hand, the hand is caused to feel little pain.

In addition, according to a method of manufacturing a gusset bag of the invention, it is possible to obtain a gusset bag which has an excellent self-standing property and causes one's hand to feel little pain even when being squeezed.

In addition, according to a method of manufacturing a spout-attached gusset bag of the invention, it is possible to obtain a spout-attached gusset bag in which a spout is attached to a gusset bag which has an excellent self-standing property and causes one's hand to feel little pain even when being squeezed.

EMBODIMENTS FOR IMPLEMENTING THE INVENTION

A gusset bag and a spout-attached gusset bag of the invention are gusset bags having the same form, except for the presence or absence of a spout. Hereinafter, as an embodiment of the gusset bag and the spout-attached gusset bag of the invention, an example of a spout-attached gusset bag having a spout will be shown and described in detail.

First Embodiment

Figure 1:
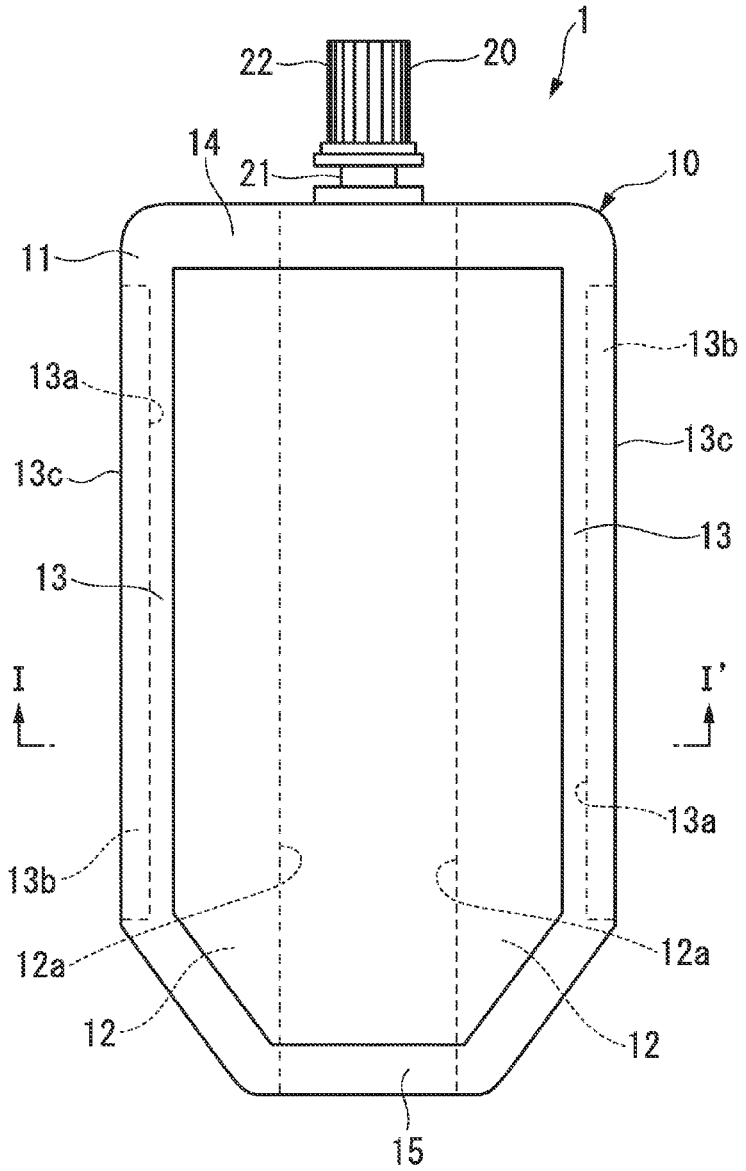
FIG. 1 is a front view showing an example of an embodiment of a spout-attached gusset bag of the invention.

As shown in FIG. 1, a spout-attached gusset bag 1 of this embodiment has a gusset bag 10 and a spout 20 liquid-tightly attached to the gusset bag 10.

Figure 2:
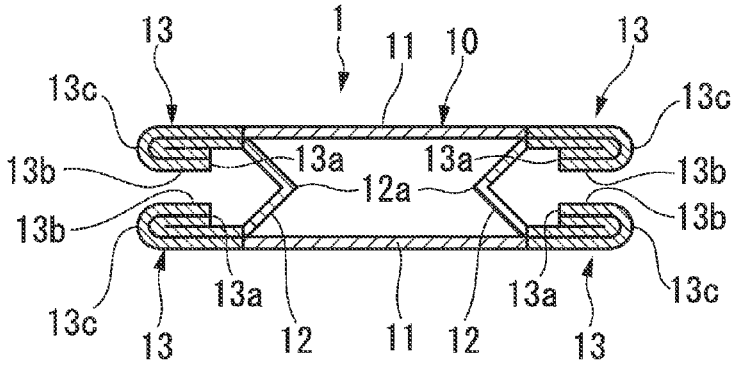
FIG. 2 is a cross-sectional view in which the spout-attached gusset bag of FIG. 1 is cut along the line I-I'.

As shown in FIGS. 1 and 2, the gusset bag 10 has a pair of flat surface portions 11, 11 facing each other, and a pair of side surface portions 12, 12 which connect the side edges of the flat surface portions 11, 11 to each other and are facing each other. The side surface portions 12, 12 are folded toward the inside of the gusset bag 10 by folding lines 12*a* which are formed at corresponding positions to each other. Moreover, four side edge sealing portions 13 are formed by heat-sealing the side edge portions of the flat surface portions 11 and the side edge portions of the side surface portions 12 together. In addition, an upper sealing portion 14 in which the flat surface portions 11 and the side surface portions 12 are sealed together is formed at the upper portion of the gusset bag 10, and a lower sealing portion 15 in which the inner surfaces of the flat surface portions 11 and the inner surfaces of the side surface portions 12 are heat-sealed together is formed at the lower portion of the gusset bag 10. Accordingly, the contents can be contained in the gusset bag 10.

The flat surface portions 11, 11 facing each other constitute the front surface and the rear surface of the spout-attached gusset bag 1.

The flat surface portion 11 is formed of a film member. Examples of the film member include a single-layer film and a multilayer film having a multilayer structure. In terms of adding various functions, the film member of the flat surface portion 11 is preferably a multilayer film, and more preferably a multilayer film having a heat-sealable innermost layer, a functional layer, and an outermost layer.

Examples of a film which is used as the innermost layer include an unstretched film formed of one or more selected from a group consisting of polyolefin resins such as low-density polyethylene (LDPE), medium-density polyethylene, high-density polyethylene, polypropylene (PP), and linear low-density polyethylene (LLDPE), mixed resins thereof, an ionomer resin, an ethylene-vinyl acetate copolymer, an ethylene-acrylic acid copolymer, an ethylene-acrylic acid methyl copolymer, and an ethylene-methacrylic acid copolymer. The thickness of the innermost layer is preferably in the range of 30 to 200 μm.

As a film which is used as the outermost layer, a film having high mechanical suitability and printability is preferably used. Examples thereof include films formed of synthetic resins such as polyester, polyamide, polypropylene, polycarbonate, and polyacetal. These films may be unstretched films, or stretched films stretched uniaxially or biaxially. In terms of printability, a uniaxially or biaxially oriented film is preferably used. Specific examples thereof include an oriented plastic films and the like such as biaxially oriented polyethylene terephthalate (PET), biaxially oriented polyamide (ONY), and biaxially oriented polypropylene (OPP). In addition, if necessary, synthetic paper, cellophane, paper, nonwoven cloth and the like can also be used. The thickness of the outermost layer is preferably in the range of 12 to 25 μm.

The functional layer can be appropriately selected in accordance with required functions such as gas barrier properties, mechanical toughness, flex resistance, pierce resistance, shock resistance, wear resistance, cold resistance, heat resistance, and chemical resistance.

Examples of a film which is used for the functional layer include metal foils such as aluminum, iron, copper, tin and the like, films of polyethylene terephthalate, polyamide, polyvinyl chloride, polycarbonate, polyvinyl alcohol, ethylene-vinyl acetate copolymer saponification product, and the like, films obtained by applying polyvinylidene chloride to the above films or vapor-depositing an inorganic material such as aluminum, silicon oxide, aluminum oxide, indium oxide, tin oxide, zirconium oxide, and magnesium oxide, films of polyvinylidene chloride, nonwoven cloth having heat insulating properties, and a foamed film.

The functional layer may be a single layer or two or more layers. The thickness of the functional layer may satisfy the functions which are required for the gusset bag 10, and is preferably in the range of 6 to 20 μm.

In addition, as a film which is used for the outermost layer, a vapor-deposited film having a vapor-deposited layer provided thereon may be used in place of providing the functional layer on a film member of the flat surface portion 11.

Examples of a vapor-deposited layer include inorganic materials such as aluminum, silicon oxide, aluminum oxide, indium oxide, tin oxide, zirconium oxide, magnesium oxide and the like.

Specific examples of the film member of the flat surface portion 11 include, for example, a film formed of PET (12 μm)/Al (7 μm)/ONY (15 μm)/LLDPE (60 μm) in order from the outermost layer.

The same member as the film member of the flat surface portion 11 can be used as a film member of the side surface portion 12. The material of at least the innermost layer of the film member of the side surface portion 12 is preferably the same as the material of the innermost layer of the film member of the flat surface portion 11 in terms of sealability.

The spout 20 has an extraction tube 21 which is inserted into the gusset bag 10 to extract the contents, and a cap 22 which is screwed to the upper portion of the extraction tube 21 to close the extraction port of the extraction tube 21. The spout 20 is liquid-tightly attached to the upper sealing portion 14 by heat-sealing in a state in which the extraction tube 21 is sandwiched between the upper edge portions of the flat surface portions 11, 11.

As a material of the spout 20, the material of at least a part of the extraction tube 21 which is sealed with the inner surface of the flat surface portion 11 is a synthetic resin.

Examples of a synthetic resin which forms at least the sealing portion of the extraction tube 21 of the spout 20 include a polyolefin resin, a polyamide resin, a polyester resin, a (meth)acrylic resin, a vinyl chloride resin, a vinylidene chloride resin, polyether sulfone, an ethylene-vinyl alcohol copolymer and the like. Among them, a polyolefin resin is preferably used in terms of excellent workability and low cost.

Examples of a polyolefin resin include a polyethylene-based resin such as high-density polyethylene, medium-density polyethylene, high-pressure-process low-density polyethylene, linear low-density polyethylene, and an ethylene-vinyl acetate copolymer, an olefin-based elastomer such as an ethylene-α-olefin copolymer, a polypropylene-based resin such as polypropylene, an ethylene-propylene random copolymer, and an α-olefin-propylene random copolymer, a cyclic polyolefin resin and the like. These resins may be blended to improve the performance, or may be partially cross-linked for the purpose of improvement in heat resistance and the like.

The spout 20 may be formed of a single material, or may be formed to have a multilayer structure formed of various resin layers.

In terms of sealability, the resin which forms at least the sealing portion of the extraction tube 21 of the spout 20 is preferably the same as the resin which forms the innermost layer of the flat surface portion 11.

Figure 3:
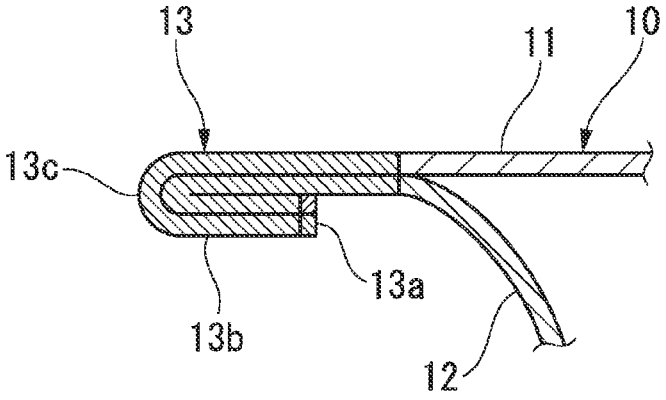
FIG. 3 is an enlarged cross-sectional view of the vicinity of a side edge sealing portion of the spout-attached gusset bag of FIG. 2.

As shown in FIGS. 2 and 3, in the spout-attached gusset bag 1 of this embodiment, a folded-back portion 13*b* which is a part of the side edge sealing portion 13 in the width direction thereof is folded back toward the side surface portion 12. Furthermore, the folded-back portion 13*b* folded toward the side surface portion 12 is adhesively fixed to a base end portion of the side edge sealing portion 13.

Figure 4:
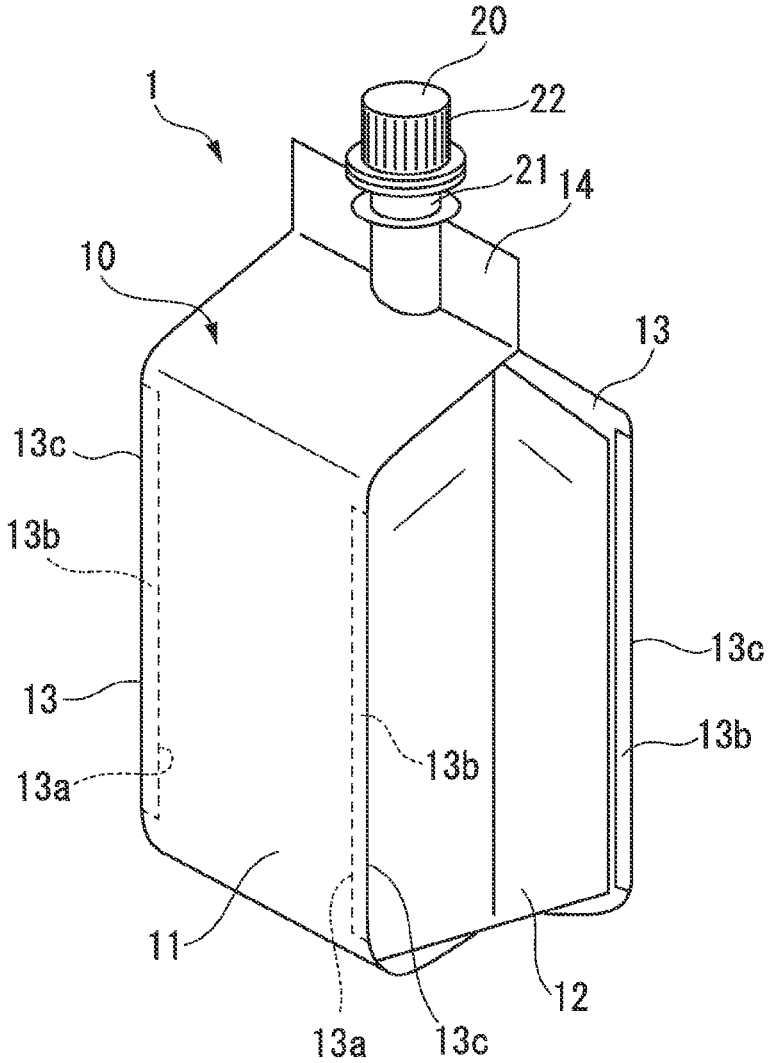
FIG. 4 is a perspective view showing an aspect in which the spout-attached gusset bag of FIG. 1 is filled with contents.

Accordingly, as shown in FIGS. 2 to 4, even in a state in which contents are contained in the gusset bag 10 so that the side edge sealing portion 13 projects toward the outside of the gusset bag 10, an end portion 13*a* of the side edge sealing portion 13 with an edge which is relatively sharp faces the gusset bag 10, and does not project to the outside of the gusset bag 10. In place of the end portion 13*a*, a folded line portion 13*c* which is rounder than the end portion 13*a* projects on the outside of the gusset bag 10.

In this manner, since the folded-back portion 13*b* of the side edge sealing portion 13 of the spout-attached gusset bag 1 is folded back and adhesively fixed as described above, the angular end portion 13*a* of the side edge sealing portion 13 does not touch one's hand but the folded line portion 13*c* which is rounder than the end portion 13*a* touches the hand when the spout-attached gusset bag 1 is squeezed. Accordingly, it is possible to push out the contents by squeezing the gusset bag 10 while causing the hand little pain.

In addition, in the side edge sealing portion 13, since the folded-back portion 13*b* is folded back and adhesively fixed, a total of four film members, that is, the two flat surface portions 11, 11 and the two side surface portions 12, 12 overlap each other in the adhered portion. As a result, since the rigidity is further increased and the function as a support is sufficiently obtained in the portion in which the folded-back portion 13*b* is adhesively fixed, the spout-attached gusset bag 1 has an excellent self-standing property.

The folded-back portion 13*b* of the side edge sealing portion 13 can be adhesively fixed by an adhesive. Examples of an adhesive include an adhesive in which a polyester resin is dispersed, a hot melt agent and the like. In addition, when the material of the outer surfaces of the flat surface portions 11, 11 and the side surface portions 12, 12 is a heat-sealable material, the folded-back portion 13*b* of the side edge sealing portion 13 may be welded by heat-sealing.

In addition, since the two flat surface portions 11, 11 and the side surface portion 12 folded toward the inside of the gusset bag 10 overlap each other at the side edge of the upper sealing portion 14, the four film members overlap each other. In this case, when the folded-back portion 13*b* of the side edge sealing portion 13 is also folded back and adhesively fixed in the upper sealing portion 14, the number of film members increases by an amount corresponding to the folded-back portion 13 at the side edge of the upper sealing portion 14, and thus the eight film members overlap each other. In this manner, when the number of film members increases at the side edge of the upper sealing portion 14, the overlapping state of the film members in the upper sealing portion 14 becomes non-uniform. In addition, when the number of overlapping film members increases at the side edge of the upper sealing portion 14, the pressure is not sufficiently applied to the vicinity of the center of the upper sealing portion 14 at the time of sealing, and thus there is concern that the sealing is not completely performed in the vicinity of the spout 20 and the contents leak.

Therefore, as shown in FIGS. 1 and 4, in the upper sealing portion 14 of the spout-attached gusset bag 1, the folded-back portion 13*b* of the side edge sealing portion 13 is preferably removed. Accordingly, the upper sealing portion 14 becomes uniform and the sealing can thus be easily and sufficiently performed, whereby the contents are easily prevented from leaking.

Figure 9A:
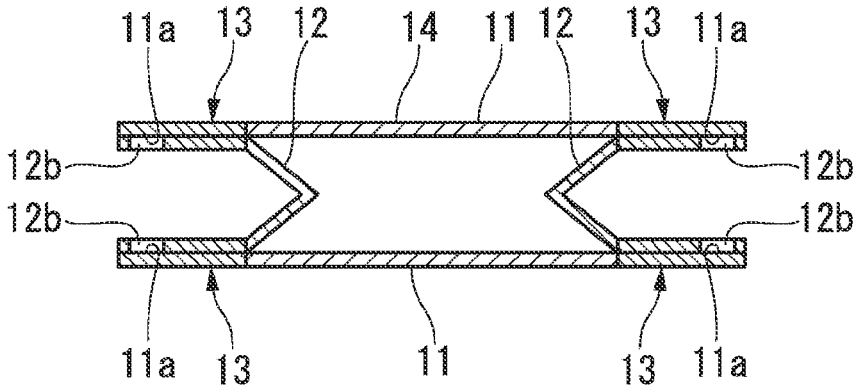
FIG. 9A is a cross-sectional view of upper portions of flat surface portions showing a step of manufacturing the spout-attached gusset bag of FIG. 1.
Figure 9B:
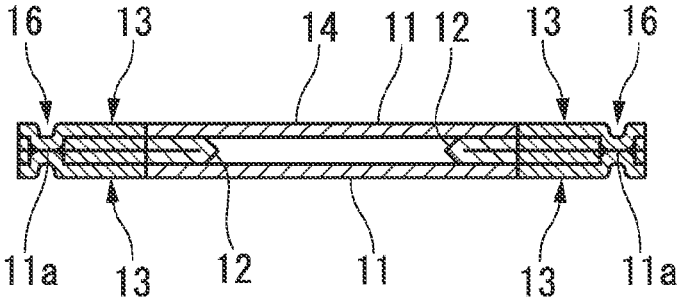
FIG. 9B is a cross-sectional view of upper portions of side surface portions showing a step of manufacturing the spout-attached gusset bag of FIG. 1.
Figure 9C:
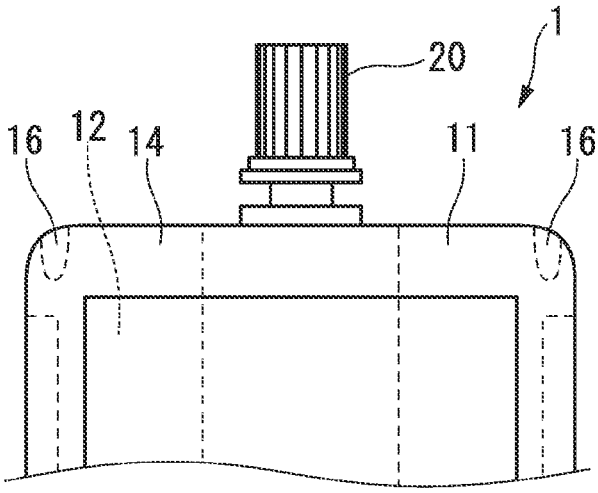
FIG. 9C is an enlarged view of the vicinity of an upper sealing portion of the gusset bag showing the step of manufacturing the spout-attached gusset bag of FIG. 1.

In the sealing of the outer surfaces of the side surface portions 12, 12 in the upper sealing portion 14, for example, as shown in FIGS. 9B and 9C, punch holes are formed at positions facing each other in the vicinities of the side edges of the side surface portions 12, 12 facing each other, and inner surfaces 11*a*, 11*a* of the flat surface portions 11, 11 are heat-sealed in the punch holes to form sealing portions 16. In addition, the outer surfaces of the side surface portions 12, 12 in the upper sealing portion 14 may be directly adhered to each other by an adhesive, a heat-sealable film or a double-sided adhesive tape.

Examples of a method of manufacturing the gusset bag of the invention include a method (β) having the following steps (β1) to (β4).

(β1) A step of conveying two long film members (C) which form flat surface portions and a plurality of long film members (D) which are center-folded along the longitudinal direction and form side surface portions so that the plurality of center-folded film members (D) are in parallel to each other between the two film members (C), the fold lines of the center-folded film members (D) positioned at both ends are directed to the inside, and the fold lines of the film members (D) parallel to each other are alternately directed to the right and left, to heat-seal the respective side edge portions of each of the film members (D) to each of the two film members (C) along the longitudinal direction.

(β2) a step of cutting the heat-sealed film members (C) and (D) between the side edge portions, facing each other, of the two film members (D) along the longitudinal direction to obtain a plurality of cylindrical film members having the flat surface portions and the side surface portions in which four side edge sealing portions are formed.

(β3) a step of folding back all or a part of the side edge sealing portion in the width direction toward the flat surface portion or the side surface portion.

(β4) a step of heat-sealing and cutting the cylindrical film member along the direction perpendicular to the longitudinal direction to divide the cylindrical film member into a plurality of pieces in the longitudinal direction.

When the spout is attached, in the step (β4), the spout is attached when an upper portion of one of the plurality of pieces into which the cylindrical film member is divided is sealed.

Hereinafter, the case of the spout-attached gusset bag 1 will be taken as an example and described in detail.

Figure 5A:
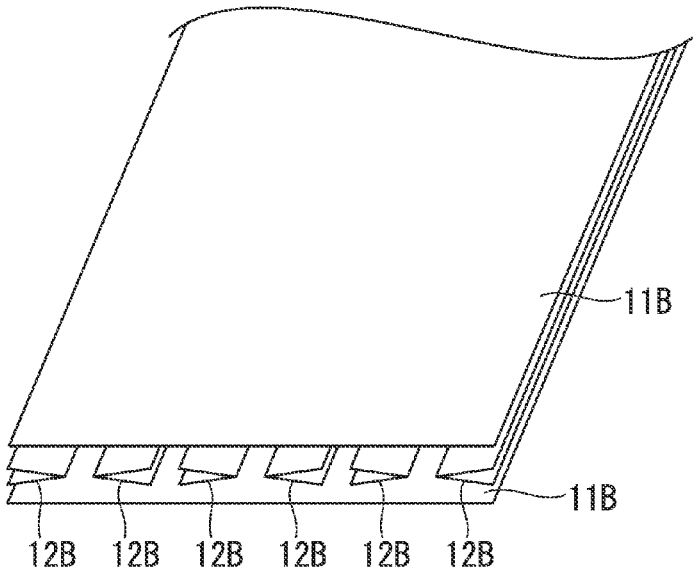
FIG. 5A is a perspective view showing a step of manufacturing the spout-attached gusset bag of FIG. 1.

Step (β1):

As shown in FIG. 5A, two long film members (C) 11B which form the pair of flat surface portions 11 facing each other and a plurality of long film members (D) 12B which are center-folded along the longitudinal direction and form the pair of side surface portions 12 facing each other are conveyed by a roller or the like. At this time, the plurality of film members (D) 12B are disposed in parallel to each other between the two film members (C) 11B. In addition, the film members (D) 12B are disposed so that the fold lines of the center-folded film member (D) 12B positioned at both ends are directed to the inside, and the fold lines of the film members (D) 12B parallel to each other are alternately directed to the right and left.

Figure 5B:
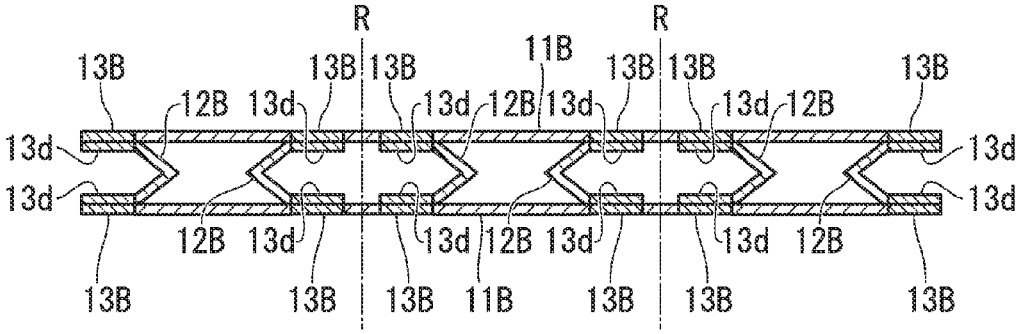
FIG. 5B is a cross-sectional view showing the step of manufacturing the spout-attached gusset bag of FIG. 1.

In addition, in this example, as shown in FIG. 5B, an adhesive is applied to an adhesion portion 13*d* for the case in which the folded-back portion 13*b* is adhesively fixed.

Next, by heat-sealing the respective side edge portions of each of the film members (D) 12B to each of the two film members (C) 11B along the longitudinal direction, heat-sealing portions 13B to be the side edge sealing portions 13 of the spout-attached gusset bag 1 are formed.

Figure 7:
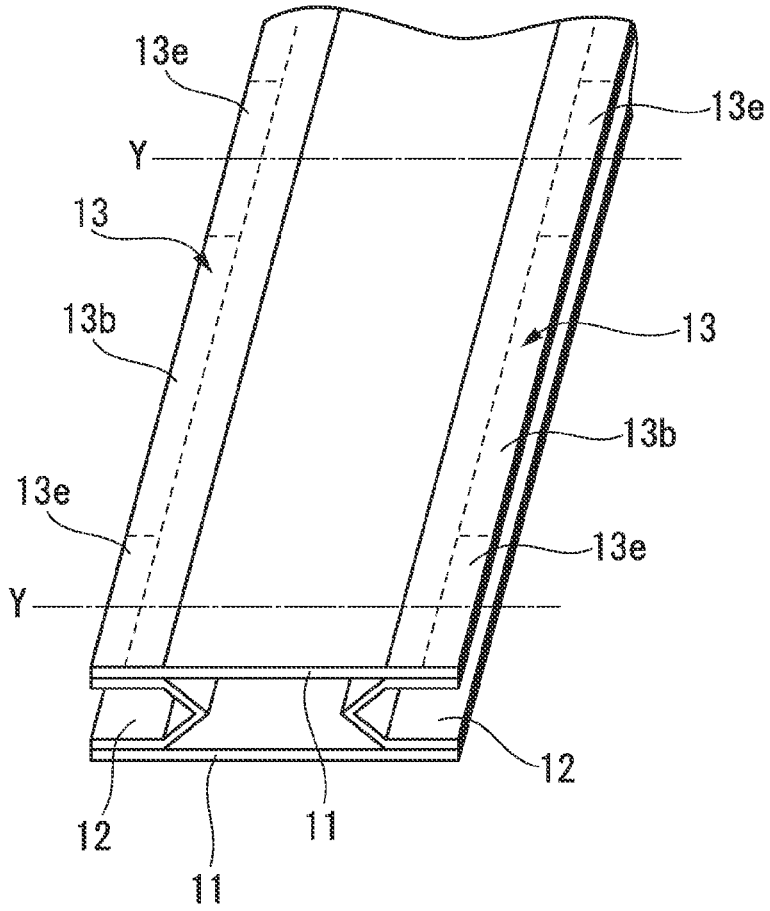
FIG. 7 is a perspective view showing a step of manufacturing the spout-attached gusset bag of FIG. 1.
Figure 8:
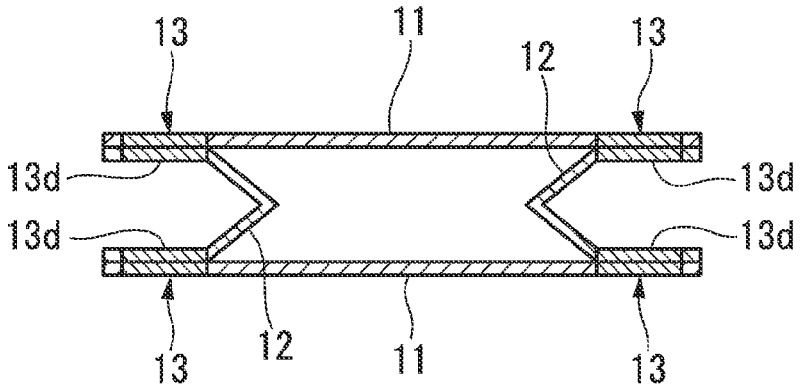
FIG. 8 is a cross-sectional view showing the step of manufacturing the spout-attached gusset bag of FIG. 1.

Step (β2):

The heat-sealing portion 13B of the film members (C) 11B and (D) 12B is cut along the straight line R, that is, along the longitudinal direction between the side edge portions, facing each other, of the two film members (D) 12B to cut out a plurality of cylindrical film members having the flat surface portions 11, 11 and the side surface portions 12, 12 in which the four side edge sealing portions 13 are formed as shown in FIGS. 7 and 8.

In addition, at this time, in a portion corresponding to the folded-back portion 13*b* of the side edge sealing portion 13, a sealing portion 13*e* is removed so that the folded-back portion 13*b* is removed at the upper sealing portion 14 of the spout-attached gusset bag 1.

Step (β3):

Each folded-back portion 13*b* of the side edge sealing portion 13 in the cylindrical film member obtained in the step (β3) is folded back toward the side surface portion 12 to be adhesively fixed by the adhesive applied to the adhesion portion 13*d*.

Step (β4):

With regard to the cylindrical film member, the inner surfaces of the flat surface portions 11 and the inner surface of the side surface portions 12 at a portion to be the lower sealing portion 15 are heat-sealed to each other along the straight line Y, that is, along the direction perpendicular to the longitudinal direction with a predetermined interval in the longitudinal direction of the film members (C) 11B and (D) 12B. Then, the film members (C) 11B and (D) 12B are cut along the straight line Y, that is, along the direction perpendicular to the longitudinal direction with a predetermined interval in the longitudinal direction of the film members (C) 11B and (D) 12B, and divided into a plurality of pieces in the longitudinal direction to obtain bag-shaped film members in which the lower sealing portion 15 is formed in the lower portions of the flat surface portions 11 and the side surface portions 12.

Next, in the upper portions of the flat surface portions 11 and the side surface portions 12 of the bag-shaped film member as one of the plurality of pieces into which the cylindrical film member is divided, the sealing of the inner surfaces of the flat surface portions 11 and the contact surfaces of the flat surface portion 11 and the side surface portion 12, and the attachment of the spout 20 are performed by heat-sealing. Furthermore, the outer surfaces of the side surface portions 12 are sealed together to form the upper sealing portion 14. Examples of a method of sealing the outer surfaces of the side surface portions 12 to each other in the upper sealing 14 include the following method.

As shown in FIG. 9A, punch holes 12*b*, 12*b* are formed to be facing each other in the vicinity of the side edge of the folded side surface portion 12 in the upper portion of the side edge sealing portion 13, and as shown in FIGS. 9B and 9C, the inner surfaces 11*a*, 11*a* of the flat surface portions 11 facing each other are brought into contact with each other and heat-sealed in the portions corresponding to the punch holes 12*b*, 12*b* to form a sealing portion 16, whereby the outer surfaces of the side surface portions 12 are sealed together.

In addition, as another method of sealing the outer surfaces of the side surface portions 12 in the upper sealing portion 14 to each other, a method of fixing the outer surfaces of the side surface portions 12 to each other by using an adhesive, a heat-sealable film or a double-sided adhesive tape is provided as an example.

The spout-attached gusset bag 1 can be obtained by the above-described steps.

The method (β) is preferably the above-described method in terms of ease of manufacturing, but is not limited to the above-described method.

In the step (β4), any of the operation of forming the lower sealing portion 15, the operation of cutting the cylindrical film member along the direction perpendicular to the longitudinal direction to be divided into a plurality of pieces in the longitudinal direction, and the operation of forming the upper sealing portion 14 and attaching the spout 20 may be performed first, or the operations may be performed at the same time. For example, after the cylindrical film member was cut along the direction perpendicular to the longitudinal direction to be divided into a plurality of pieces in the longitudinal direction, the lower portions of the divided cylindrical film members may be sealed and the upper portions thereof may be sealed with the attached spout.

In addition, the operation of folding back and adhesively fixing the side edge sealing portion 13 in the step (β3) is not limited to being before the step (β4). For example, after the cylindrical film member was cut along the direction perpendicular to the longitudinal direction to be divided into a plurality of pieces in the longitudinal direction, the side edge sealing portions of the divided cylindrical film members may be folded back and adhesively fixed. In addition, in accordance with the used material of the film member, the side edge sealing portion 13 may be fixed by heat-sealing without using the adhesive.

In addition, examples of a method of manufacturing the gusset bag of the invention other than the method (β) include a method (γ) having the following steps (γ1) to (γ4).

(γ1) A step of conveying two long film members (E) which form flat surface portions and a plurality of long cylindrical film members (F) which form side surface portions so that the plurality of film members (F) are in parallel to each other between the two film members (E) to heat-seal the center portions of the film members (F) and the two film members (E) along the longitudinal direction.

(γ2) a step of cutting the heat-sealing portions of the film members (E) and (F) along the longitudinal direction to obtain a cylindrical film member having the flat surface portions and the side surface portions in which four side edge sealing portions are formed.

(γ3) a step of folding back all or a part of the side edge sealing portion in the width direction toward the flat surface portion or the side surface portion.

(γ4) a step of heat-sealing and cutting the cylindrical film member along the direction perpendicular to the longitudinal direction to divide the cylindrical film member into a plurality of pieces in the longitudinal direction.

When the spout is attached, in the step (γ4), the spout is attached when an upper portion of one of the plurality of pieces into which the cylindrical film member is divided is sealed.

Hereinafter, the case of the spout-attached gusset bag 1 will be taken as an example and described in detail.

Figure 6A:
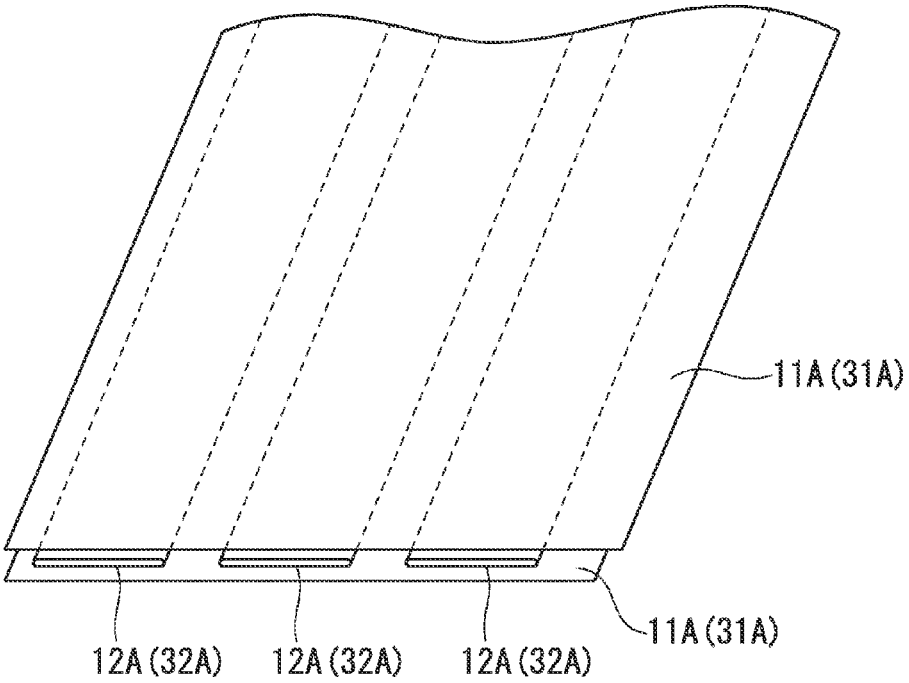
FIG. 6A is a perspective view showing a step of manufacturing the spout-attached gusset bag of FIG. 1.
Figure 6B:
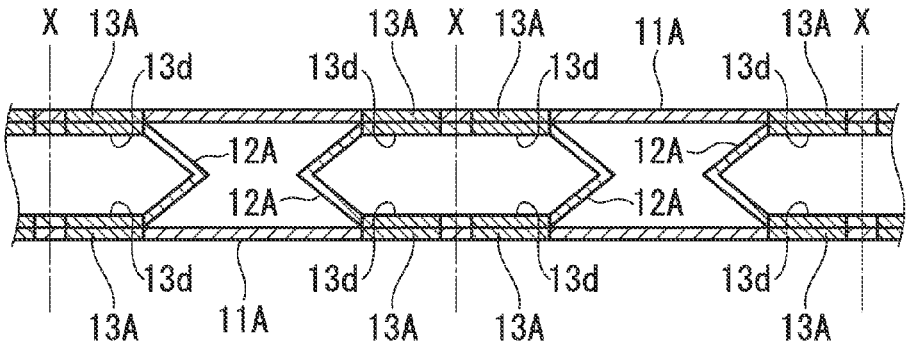
FIG. 6B is a cross-sectional view showing the step of manufacturing the spout-attached gusset bag of FIG. 1.

Step (γ1):

As shown in FIG. 6A, two long film members (E) 11A which form the pair of flat surface portions 11 facing each other and a plurality of long cylindrical film members (F) 12A which form the pair of side surface portions 12 facing each other are conveyed by a roller or the like so that the plurality of film members (F) 12A are in parallel to each other between the two film members (E) 11A. In this example, as shown in FIG. 6B, an adhesive is applied to the adhesion portion 13*d* for the case in which the folded-back portion 13*b* is adhesively fixed.

Next, by heat-sealing the center portions of the film members (F) 12A and the two film members (E) 11A along the longitudinal direction, heat-sealing portions 13A to be the side edge sealing portions 13 of the spout-attached gusset bag 1 are formed. In this example, the heat-sealing portion 13A is formed so that the center portion thereof in the direction perpendicular to the longitudinal direction is not heat-sealed.

Step (γ2):

The heat-sealing portion 13A of the film members (E) 11A and (F) 12A is cut along the straight line X, that is, along the longitudinal direction at the non-heat-sealed portion of the center portion of the heat-sealing portion 13A to cut out a plurality of cylindrical film members having the flat surface portions 11, 11 and the side surface portions 12, 12 in which the four side edge sealing portions 13 are formed as shown in FIGS. 7 and 8.

In addition, at this time, in a portion corresponding to the folded-back portion 13*b* of the side edge sealing portion 13, the sealing portion 13*e* is removed so that the folded-back portion 13*b* is removed at the upper sealing portion 14 of the spout-attached gusset bag 1.

Step (γ3):

Each folded-back portion 13*b* of the side edge sealing portion 13 in the cylindrical film member obtained in the step (γ2) is folded back toward the side surface portion 12 to be adhesively fixed by the adhesive applied to the adhesion portion 13*d*.

Step (γ4):

With regard to the cylindrical film member, the inner surfaces of the flat surface portions 11 and the inner surface of the side surface portions 12 at a portion to be the lower sealing portion 15 are heat-sealed to each other along the straight line Y, that is, along the direction perpendicular to the longitudinal direction with a predetermined interval in the longitudinal direction of the film members (E) 11A and (F) 12A. Then, the film members (E) 11A and (F) 12A are cut along the straight line Y, that is, along the direction perpendicular to the longitudinal direction with a predetermined interval in the longitudinal direction of the film members (E) 11A and (F) 12A, and divided into a plurality of pieces in the longitudinal direction to obtain bag-shaped film members in which the lower sealing portion 15 is formed in the lower portions of the flat surface portions 11 and the side surface portions 12.

Next, in the upper portions of the flat surface portions 11 and the side surface portions 12 of the bag-shaped film member as one of the plurality of pieces into which the cylindrical film member is divided, the sealing of the inner surfaces of the flat surface portions 11 and the contact surfaces of the flat surface portion 11 and the side surface portion 12, and the attachment of the spout 20 are performed by heat-sealing. Furthermore, the outer surfaces of the side surface portions 12 are sealed together to form the upper sealing portion 14. The method of sealing the outer surfaces of the side surface portions 12 in the upper sealing 14 can be performed in the same manner as in the step (β4) of the method (β).

The spout-attached gusset bag 1 can be obtained by the above-described steps.

The method (γ) is preferably the above-described method in terms of ease of manufacturing, but is not limited to the above-described method.

In the step (γ4), any of the operation of forming the lower sealing portion 15, the operation of cutting the cylindrical film member along the direction perpendicular to the longitudinal direction to be divided into a plurality of pieces in the longitudinal direction, and the operation of forming the upper sealing portion 14 and attaching the spout 20 may be performed first, or the operations may be performed at the same time. For example, after the cylindrical film member was cut along the direction perpendicular to the longitudinal direction to be divided into a plurality of pieces in the longitudinal direction, the lower portions of the divided cylindrical film members may be sealed and the upper portions thereof may be sealed with the attached spout.

In addition, the operation of folding back and adhesively fixing the side edge sealing portion 13 in the step (γ3) is not limited to being before the step (γ4). For example, after the cylindrical film member was cut along the direction perpendicular to the longitudinal direction to be divided into a plurality of pieces in the longitudinal direction, the side edge sealing portions of the divided cylindrical film members may be folded back and adhesively fixed. In addition, in accordance with the used material of the film member, the side edge sealing portion 13 may be fixed by heat-sealing without using the adhesive.

In addition, in the step (γ1), when the film members (E) 11A and (F) 12A are heat-sealed to form the heat-sealing portion 13A, the center portion of the film member (F) 12A in the width direction may not be in a non-heat-sealed state, and may be continuously heat-sealed.

In addition, in the step (γ1), together with the film members (E) 11A and (F) 12A, the same long film members center-folded along the longitudinal direction as those in the method (β) are preferably conveyed so as to be placed at both side ends of the two film members (E) 11A so that the fold lines thereof are directed to the inside, to heat-seal the side edge portions of the center-folded film members and the two film members (E) 11A. Accordingly, it is possible to make full use of both side ends of the film member (E) 11A in the manufacturing of the gusset bag.

As a method of manufacturing the spout-attached gusset bag 1, the method (β) is more preferably used than the method (γ).

In the above-described spout-attached gusset bag 1, the folded-back portion 13*b* of the side edge sealing portion 13 in which the side edge portion of the flat surface portion 11 and the side edge portion of the side surface portion 12 are heat-sealed together is folded back toward the side surface portion 12 and adhesively fixed. Accordingly, when the gusset bag 1 is squeezed by one's hand, the end portion 13*a* does not touch the hand, but the folded line portion 13*c* touches the hand. Since the folded line portion 13*c* is round with no edges, one's hand is caused to feel little pain even when the contents are pushed out by squeezing the gusset bag 1.

Figure 10A:
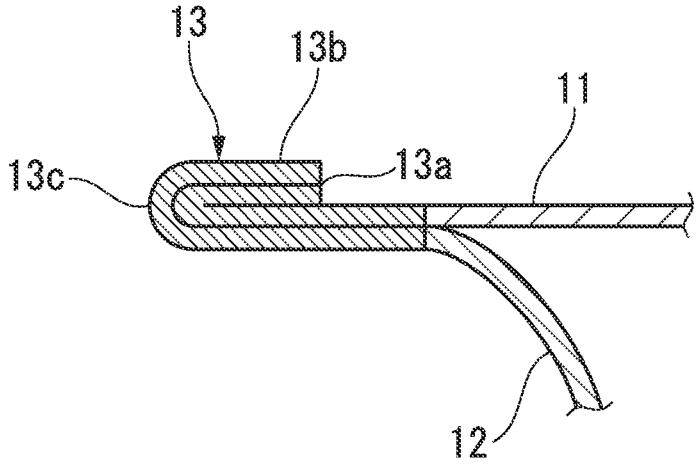
FIG. 10A is a cross-sectional view showing another form of the side edge sealing portion of the gusset bag.
Figure 10B:
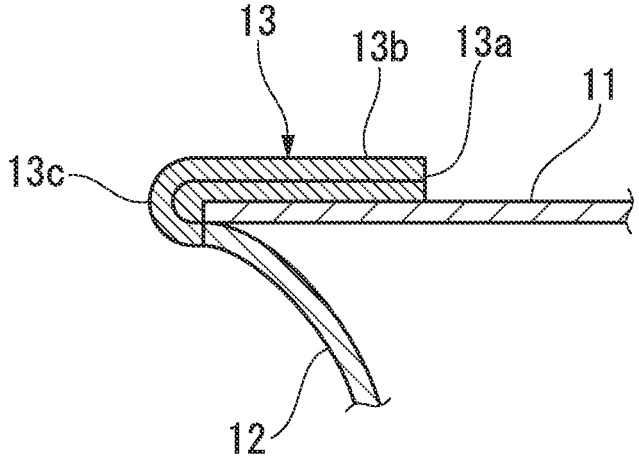
FIG. 10B is a cross-sectional view showing another form of the side edge sealing portion of the gusset bag.

The gusset bag of this embodiment is not limited to the above-described spout-attached gusset bag 1. For example, as shown in FIG. 10A, the folded-back portion 13*b* of the side edge sealing portion 13 may be folded back toward the flat surface portion 11 and adhesively fixed. In addition, as shown in FIG. 10B, the entire side edge sealing portion 13 may be folded back toward the flat surface portion 11 and adhesively fixed to the flat surface portion 11. In addition, as shown in FIG. 10C, the entire side edge sealing portion 13 may be folded back toward the side surface portion 12 and adhesively fixed to the side surface portion 12.

In the gusset bag of the invention, the entire side edge sealing portion 13 is preferably folded back toward the flat surface portion 11 or the side surface portion 12.

Figure 10C:
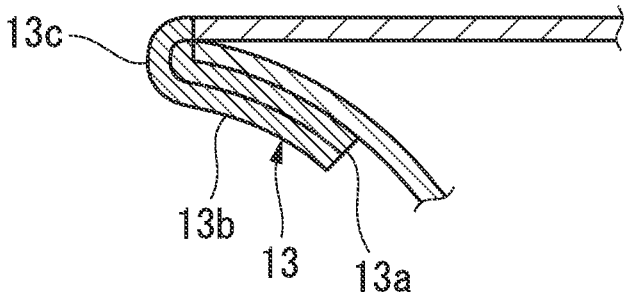
FIG. 10C is a cross-sectional view showing another form of the side edge sealing portion of the gusset bag.
Figure 11:
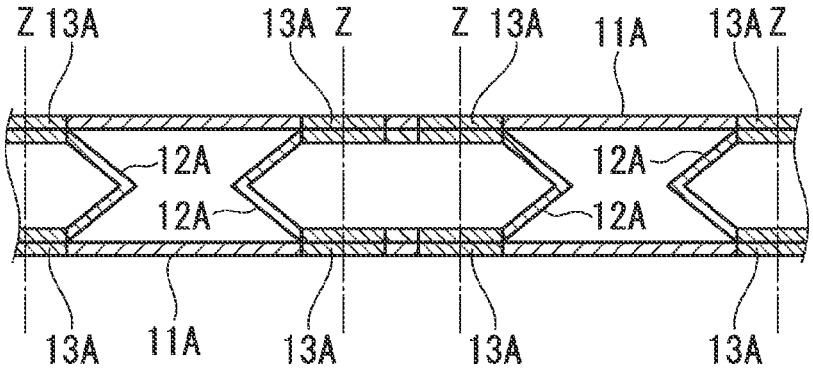
FIG. 11 is a view showing a step of manufacturing a gusset bag of another embodiment.

In addition, as shown in FIGS. 10B and 10C, when the entire side edge sealing portion 13 is folded back in the manufacture of the gusset bag by the method (γ), in place of the cutting the film members (E) 11A and (F) 12A along the straight line X, the film members are preferably cut along the straight line Z as shown in FIG. 11, that is, the film members are preferably cut so that the side edge sealing portion 13 is further shortened.

Figure 12:
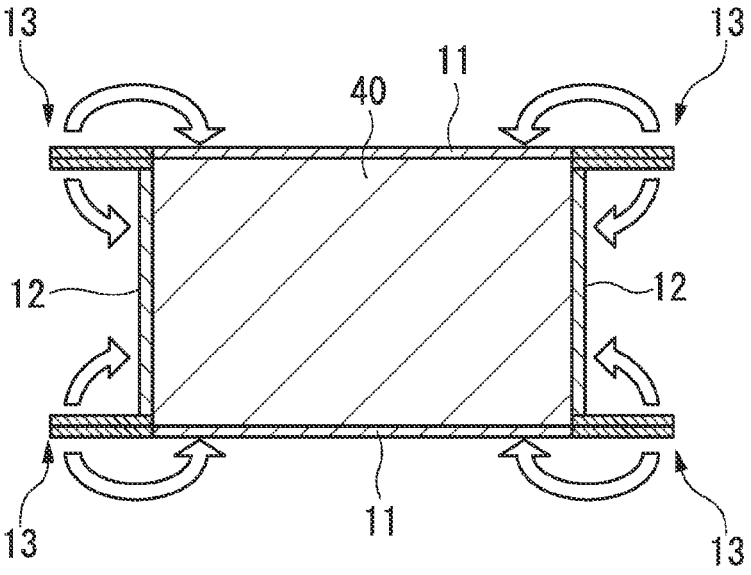
FIG. 12 is a cross-sectional view showing the step of manufacturing the spout-attached gusset bag of FIG. 1.

Particularly, in the manufacturing method when the entire side edge sealing portion 13 is folded back toward the flat surface portion 11 or the side surface portion 12, it is preferable to use a method of folding back and adhesively fixing the entire side edge sealing portion 13 in a state in which a quadrangular prism-shaped mandrel 40 (support) is inserted into the cylindrical film member formed of the flat surface portions 11, 11 and the side surface portions 12, 12 as shown in FIG. 12. When using this method, it is possible to easily fold back and adhesively fix the side edge sealing portion 13, and thus the spout-attached gusset bag can be more efficiently manufactured.

In addition, in the spout-attached gusset bag of this embodiment, two or more of the four kinds of folding-back methods illustrated in FIGS. 3 and 10A to 10C may be used in combination for the four side edge sealing portions 13. That is, in the gusset bag of this embodiment, a form of folding back the entire side edge sealing portion 13 and a form of folding back a part of the side edge sealing portion 13 may be used in combination, and a form of folding back the side edge sealing portion 13 toward the flat surface portion 11 and a form of folding back the side edge sealing portion 13 toward the side surface portion 12 may be used in combination.

In addition, the number of the side edge sealing portions 13 is not limited to four, and may be less than four. A spout-attached gusset bag in which the number of the side edge sealing portions 13 is not four is preferably a spout-attached gusset bag in which one flat surface portion and a pair of side surface portions are formed of one film member, and the side edge portions of the side surface portions formed of the above film member and the side edge portions of the other flat surface portion are heat-sealed together to form the two side edge sealing portions.

Figure 13A:
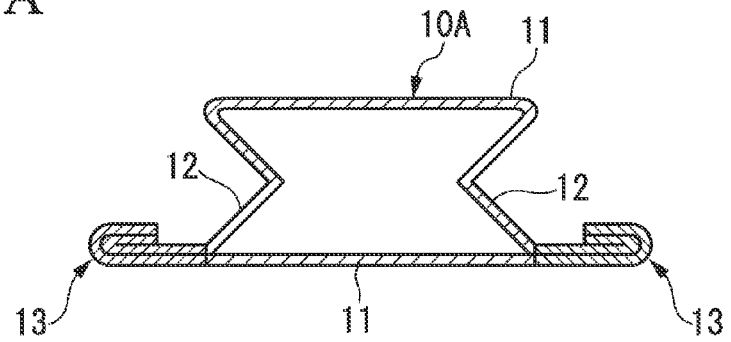
FIG. 13A is a cross-sectional view showing another embodiment of the spout-attached gusset bag of the invention.

Specifically, as shown in FIG. 13A, the spout-attached gusset bag preferably has a gusset bag 10A in which the flat surface portion 11 to be the front surface of the bag and the pair of side surface portions 12 facing each other are formed of one integrated film member, the side edge portions of the side surface portions 12, 12 of the above film member and the side edge portions of the other flat surface portion 11 are heat-sealed together to form the two side edge sealing portions 13, and a part of the side edge sealing portion 13 is folded back toward the side surface portion 12 and adhesively fixed. In this gusset bag 10A, the entire side edge sealing portion 13 may be folded back, the side edge sealing portion 13 may be folded back toward the flat surface portion 11, or these may be used in combination.

Figure 13B:
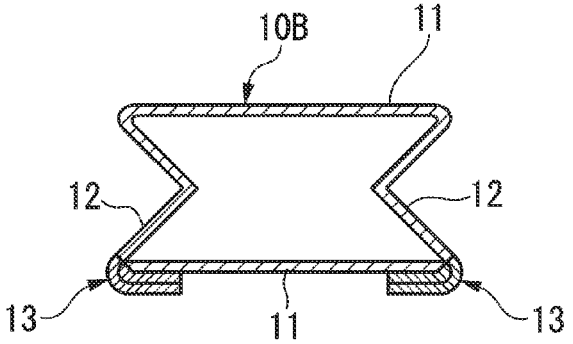
FIG. 13B is a cross-sectional view showing another embodiment of the spout-attached gusset bag of the invention.

In addition, as shown in FIG. 13B, the spout-attached gusset bag particularly preferably has a gusset bag 10B in which the flat surface portion 11 to be the front surface of the bag and the pair of side surface portions 12 facing each other are formed of one integrated film member, the side edge portions of the side surface portions 12, 12 of the above film member and the side edge portions of the other flat surface portion 11 are heat-sealed together to form the two side edge sealing portions 13, and the entire side edge sealing portion 13 is folded back toward the front surface portion 11 which forms the rear surface and adhesively fixed. The spout-attached gusset bag having the gusset bag 10B has no side edge sealing portion in the front surface, and thus one's hand is caused to feel little pain particularly when squeezing the bag from the front surface, and the appearance is also excellent. In addition, since the side edge sealing portions are formed of the flat surface portion which form the rear surface and the side surface portions at both sides of the flat surface portion, an excellent self-standing property can be obtained due to the side edge sealing portion functioning as a support, and the swelling of the body portion when containing contents is also suppressed.

Figure 13C:
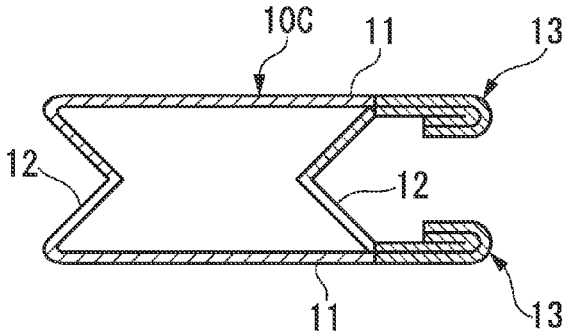
FIG. 13C is a cross-sectional view showing another embodiment of the spout-attached gusset bag of the invention.

In addition, as shown in FIG. 13C, the spout-attached gusset bag of the invention may be a gusset bag 10C in which one side surface portion and a pair of flat surface portions facing each other are integrally formed of one film member, the two side edge sealing portions 13 by heat-sealing are formed only in the side of the other side surface portion, and the side edge sealing portion 13 is folded back toward the flat surface portion or the side surface portion and adhesively fixed.

Figure 13D:
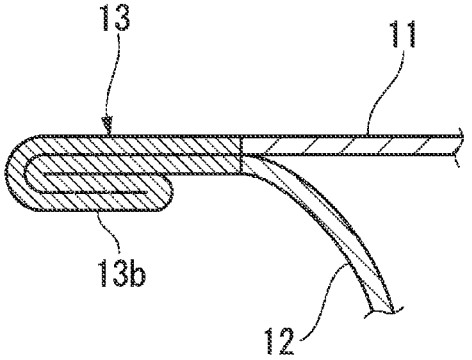
FIG. 13D is a cross-sectional view showing another form of the side edge sealing portion of the gusset bag.

In addition, when the flat surface portion 11 and the side surface portion 12 are formed of a film member integrated at any portion, as shown in FIG. 13D, the side edge sealing portion 13 may be formed by heat-sealing a portion corresponding to the side edge portion of the flat surface portion 11 and a portion corresponding to the side edge portion of the side surface portion 12 to each other, and all or a part of the side edge sealing portion 13 may be folded back toward the flat surface portion 11 or the side surface portion 12, and adhesively fixed. Accordingly, it is possible to prevent one's hand from feeling pain when the gusset bag is squeezed and improve the self-standing property of the spout-attached gusset bag by forming the side edge sealing portion to be a support.

In addition, the folded-back portion 13*b* of the side edge sealing portion 13 may not be necessarily adhesively fixed to the flat surface portion 11 or the side surface portion 12 if the folded-back state can be stably maintained.

Examples of a method of manufacturing the gusset bag having the same form as those of the gusset bags 10A and 10B include a method (α) having the following steps (α1) to (α4).

(α1)) A step of conveying a long film member (A) which forms one flat surface portion and a pair of side surface portions with a long film member (B) which forms the other flat surface portion in a state in which the long film member (A) is folded so that a plurality of the one flat surface portion and the pair of side surface portions are formed in parallel to each other along the longitudinal direction, to heat-seal the portion between the neighboring side surface portions of the film member (A) to the film member (B) along the longitudinal direction and heat-seal each of the portions at the side ends from the side surface portions positioned at both ends of the film member (A) to the film member (B) along the longitudinal direction.

(α2) a step of cutting the heat-sealing portion of the film members (A) and (B) along the longitudinal direction to obtain a plurality of cylindrical film members having the flat surface portions and the side surface portions in which two side edge sealing portions are formed.

(α3) a step of folding back all or a part of the side edge sealing portion in the width direction toward the flat surface portion or the side surface portion.

(α4) a step of heat-sealing and cutting the cylindrical film member along the direction perpendicular to the longitudinal direction to divide the cylindrical film member into a plurality of pieces in the longitudinal direction.

When the spout is attached, in the step (α4), the spout is attached when an upper portion of one of the plurality of pieces into which the cylindrical film member is divided is sealed.

Hereinafter, the case of a spout-attached gusset bag having the gusset bag 10B will be taken as an example and described in detail.

Figure 14A:
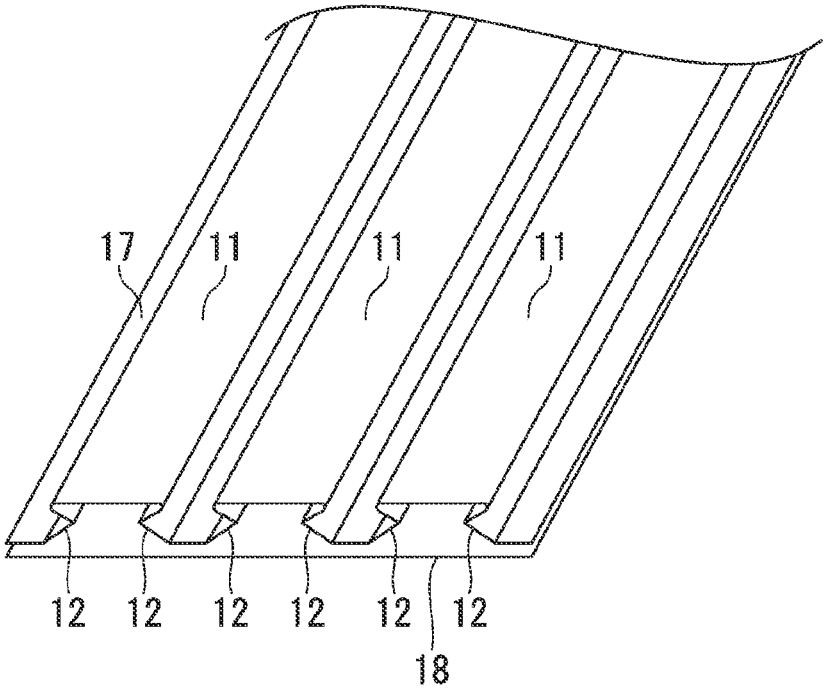
FIG. 14A is a perspective view showing a step of manufacturing of another example of the spout-attached gusset bag of the invention.
Figure 14B:
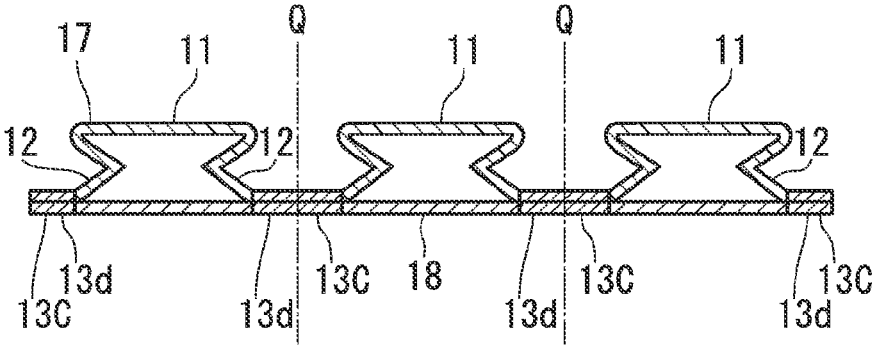
FIG. 14B is a perspective view showing the step of manufacturing of another example of the spout-attached gusset bag of the invention.

Step (α1):

As shown in FIG. 14A, a long film member (A) 17 which forms one flat surface portion 11 and the pair of side surface portions 12, 12 is conveyed by a roller or the like with a long film member (B) 18 which forms the other flat surface portion 11 in a state in which the film member (A) 17 is folded so that a plurality of the one flat surface portion 11 and the pair of side surface portions 12, 12 are formed in parallel to each other along the longitudinal direction. In addition, in this example, as shown in FIG. 14B, an adhesive is applied to the adhesion portion 13*d* for the case in which the folded-back portion is adhesively fixed.

Next, the portion between the neighboring side surface portions 12 of the film member (A) 17 and the film member (B) 18 are heat-sealed together along the longitudinal direction, and each of the portions at the side ends from the side surface portions positioned at both ends of the film member (A) 17 and the film member (B) 18 are heat-sealed together along the longitudinal direction, whereby the heat-sealing portions 13C to be the side edge sealing portions 13 are formed.

Figure 15:
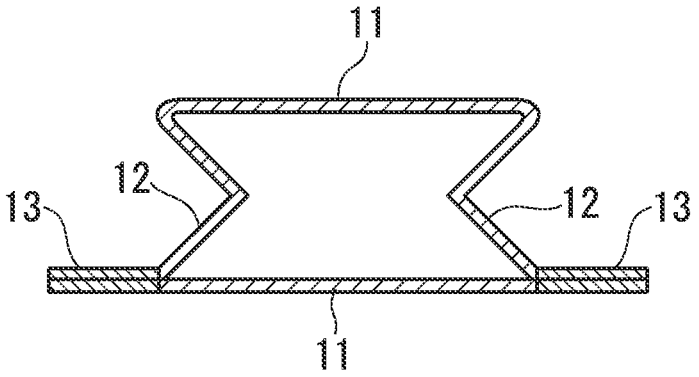
FIG. 15 is a cross-sectional view showing the step of manufacturing of another example of the spout-attached gusset bag of the invention.

Step (α2):

The heat-sealing portion 13C of the film members (A) 17 and (B) 18 is cut along the straight line Q, that is, along the longitudinal direction at the center portion of the heat-sealing portion 13C to cut out a plurality of cylindrical film members having the flat surface portions 11, 11 and the side surface portions 12, 12 in which the two side edge sealing portions 13 are formed as shown in FIG. 15.

In addition, if necessary, in the same manner as in the method (β), a part of a portion corresponding to the side edge sealing portion 13 is removed so that no folded-back portion remains in the upper sealing portion of the spout-attached gusset bag.

Step (α3):

Each of the entire side edge sealing portions 13 of the cylindrical film member obtained in the step (α2) is folded back toward the flat surface portion 11 to be adhesively fixed by the adhesive applied to the adhesion portion 13*d*.

Step (α4):

In the same manner as in the step (β4) of the method (β), the heat-sealing and cutting are performed along the direction perpendicular to the longitudinal direction and the division into a plurality of pieces is performed in the longitudinal direction, whereby bag-shaped film members are obtained in which the lower sealing portion 15 is formed. Then, in the same manner as in the step (β4) of the method (β), the sealing of the upper portions of the flat surface portions 11 and the side surface portions 12 and the attachment of the spout 20 are performed.

The method (α) is preferably the above-described method in terms of ease of manufacturing, but is not limited to the above-described method.

In the step (α4), any one of the operation of forming the lower sealing portion 15, the operation of cutting the cylindrical film member along the direction perpendicular to the longitudinal direction to be divided into a plurality of pieces in the longitudinal direction, and the operation of forming the upper sealing portion 14 and attaching the spout 20 may be performed first, or the operations may be performed at the same time. For example, after the cylindrical film member was cut along the direction perpendicular to the longitudinal direction to be divided into a plurality of pieces in the longitudinal direction, the lower portions of the divided cylindrical film members may be sealed and the upper portions thereof may be sealed with the attached spout.

In addition, the operation of folding back and adhesively fixing the side edge sealing portion 13 in the step (α3) is not limited to being before the step (α4). For example, after the cylindrical film member was cut along the direction perpendicular to the longitudinal direction to be divided into a plurality of pieces in the longitudinal direction, the side edge sealing portions of the divided cylindrical film members may be folded back and adhesively fixed. In addition, in accordance with the used material of the film member, the side edge sealing portion 13 may be fixed by heat-sealing without using the adhesive.

Second Embodiment

Next, another embodiment of the spout-attached gusset bag of the invention will be described. In this embodiment, the same parts as those in the spout-attached gusset bag 1 will be denoted by the same reference signs, and descriptions thereof will be omitted.

Figure 16:
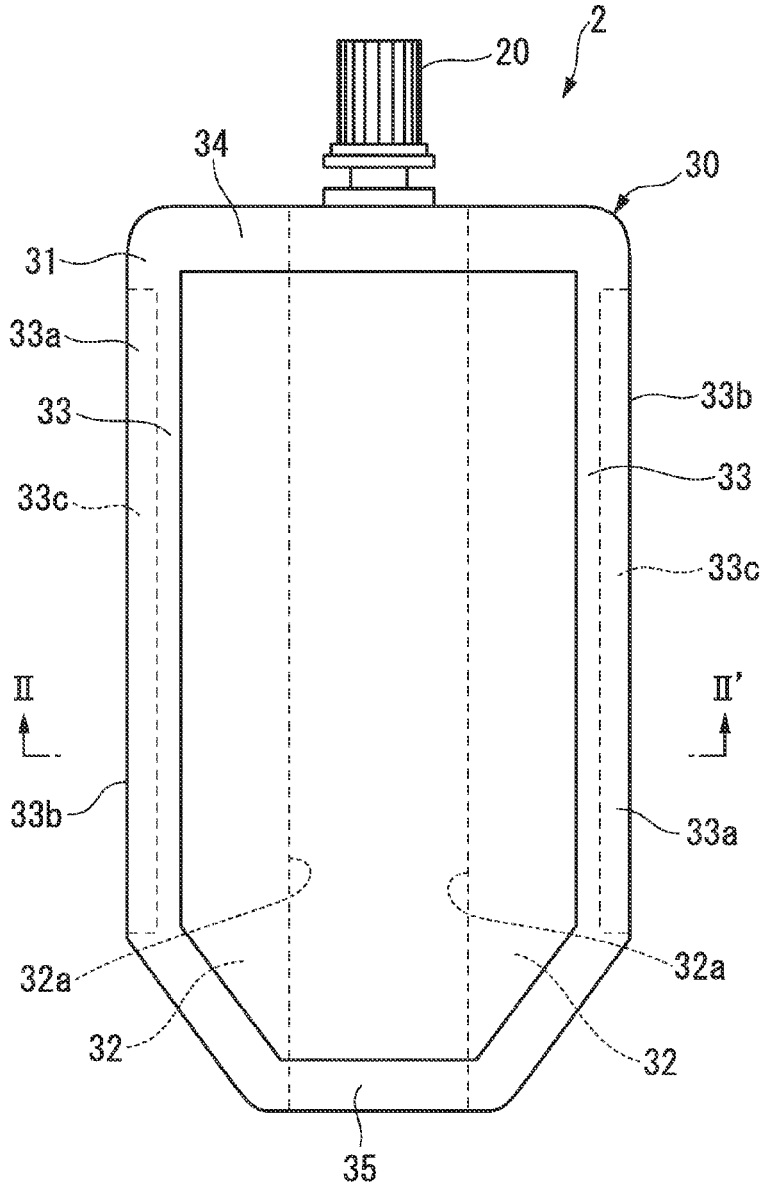
FIG. 16 is a front view showing another embodiment of the spout-attached gusset bag of the invention.

As shown in FIG. 16, a spout-attached gusset bag 2 of this embodiment has a gusset bag 30 and a spout 20 liquid-tightly attached to the gusset bag 30.

Figure 17:
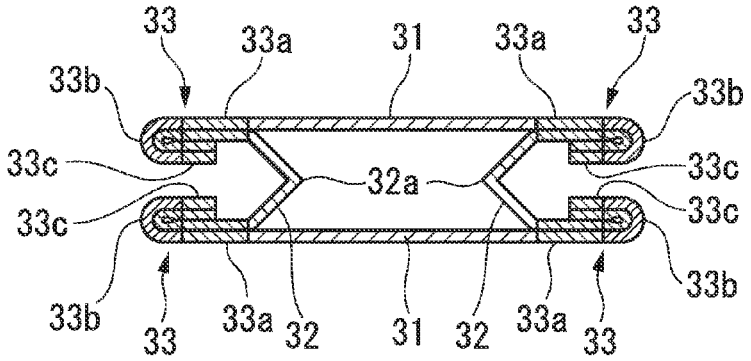
FIG. 17 is a cross-sectional view in which the spout-attached gusset bag of FIG. 16 is cut along the line II-II'.

As shown in FIGS. 16 and 17, the gusset bag 30 has a pair of flat surface portions 31, 31 facing each other, and a pair of side surface portions 32, 32 which connect the side edges of the flat surface portions 31, 31 to each other and are facing each other. The side surface portions 32, 32 are folded toward the inside of the gusset bag 30 by folding lines 32*a* which are formed at corresponding positions to each other. Moreover, four side edge sealing portions 33 are formed by heat-sealing the side edge portions of the flat surface portions 31 and the side edge portions of the side surface portions 32 together. In addition, an upper sealing portion 34 in which the flat surface portions 31 and the side surface portions 32 are put together and sealed is formed at the upper portion of the gusset bag 30, and a lower sealing portion 35 in which the inner surfaces of the flat surface portions 31 and the inner surface of the side surface portions 32 are heat-sealed together is formed at the lower portion of the gusset bag 30. Accordingly, the contents can be contained in the gusset bag 30.

For the film members of the flat surface portion 31 and the side surface portion 32, it is possible to use the same material as the film members of the flat surface portion 11 and the side surface portion 12 of the spout-attached gusset bag 1, and a preferred aspect regarding the film member is similar. That is, the spout-attached gusset bag 2 is the same as the spout-attached gusset bag 1, other than the form of the side edge sealing portion 33.

Figure 18:
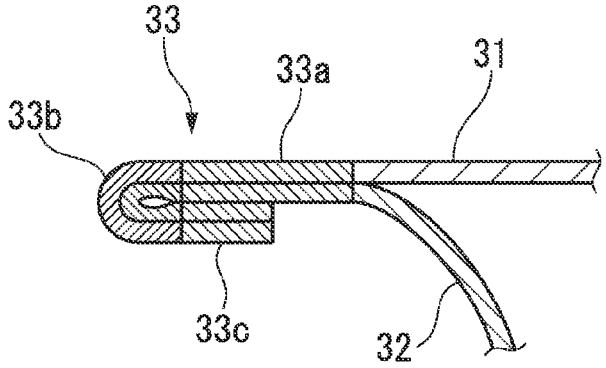
FIG. 18 is an enlarged cross-sectional view of the vicinity of a side edge sealing portion of the spout-attached gusset bag of FIG. 17.

As shown in FIGS. 17 and 18, the side edge sealing portion 33 of the spout-attached gusset bag 2 has an unsealed portion 33*b* which is not heat-sealed along the vertical direction in the middle of the side edge sealing portion 33 in the width direction thereof. A tip end portion (folded-back portion 33*c*) of the side edge sealing portion 33 is folded back toward the side surface portion 32 along the unsealed portion 33*b*, and adhesively fixed to a base end portion of the side edge sealing portion 33. That is, in order from the base end of the side edge sealing portion 33 toward the tip end, a sealing portion 33*a* which is heat-sealed, the unsealed portion 33*b* which is not heat-sealed, and the folded-back portion 33*c* which his heat-sealed are provided.

In the spout-attached gusset bag 2, the tip end of a portion projecting to the outside from the gusset bag 30 of the side edge sealing portion 33 is the unsealed portion 33*b*. Since the unsealed portion 33*b* is not heat-sealed, the unsealed portion 33*b* has lower rigidity and is softer than the folded line portion 13*c* of the side edge sealing portion 13 of the spout-attached gusset bag 1.

In addition, in the spout-attached gusset bag 2, since the sealing portion 33*a* and the folded-back portion 33*c* are heat-sealed together, these portions sufficiently function as a support, and thus the gusset bag 2 has an excellent self-standing property.

The spout-attached gusset bag 2 is manufactured in the same manner as in the manufacturing of the spout-attached gusset bag 1 by the method (β) or (γ), except for the form of the heat-sealing portion which is formed in the step (β2) or (γ2) and the folding-back of the side edge sealing portion in the step (β3) or (γ3). When the method (γ) is used, for example, the following method is exemplified.

Figure 19:
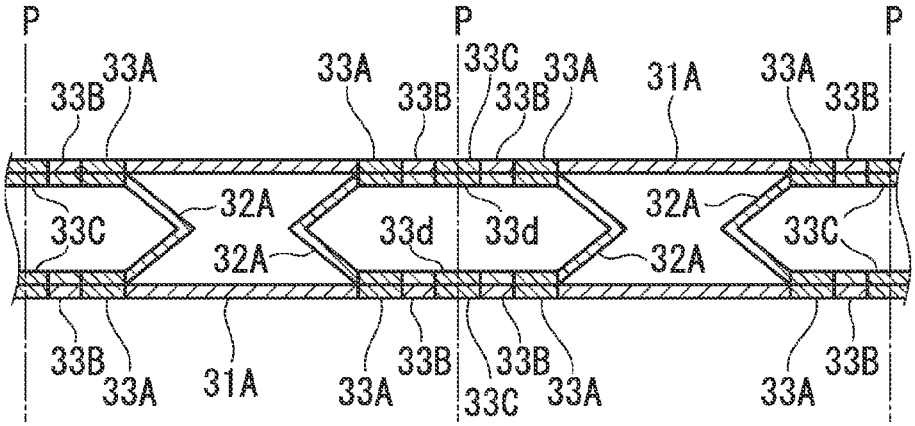
FIG. 19 is a cross-sectional view showing a step of manufacturing the spout-attached gusset bag of FIG. 16.

Step (γ1):

As shown in FIG. 6A, two long film members (E) 31A which form the pair of flat surface portions 31 facing each other and a plurality of long cylindrical film members (F) 32A which form the pair of side surface portions 32 facing each other are conveyed by a roller or the like so that the plurality of film members (E) 32A are in parallel to each other between the film members (E) 31A. In addition, in this example, as shown in FIG. 19, an adhesive is applied to an adhesion portion 33*d* for the case in which the folded-back portion 33*c* is adhesively fixed.

By heat-sealing the center portions of the film members (F) 32A and the film members (E) 31A along the longitudinal direction, heat-sealing portions to be the side edge sealing portions 33 are formed. The heat-sealing portions are formed in order of a sealing portion 33A which is heat-sealed, an unsealed portion 33B which is not heat-sealed, a sealing portion 33C which is heat-sealed, an unsealed portion 33B which is not heat-sealed, and a sealing portion 33A which is heat-sealed, in the direction perpendicular to the longitudinal direction.

Figure 20:
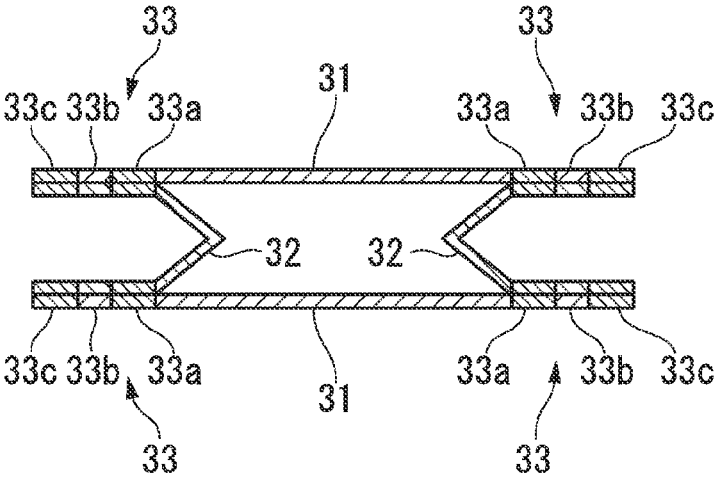
FIG. 20 is a cross-sectional view showing the step of manufacturing the spout-attached gusset bag of FIG. 16.
Figure 21A:
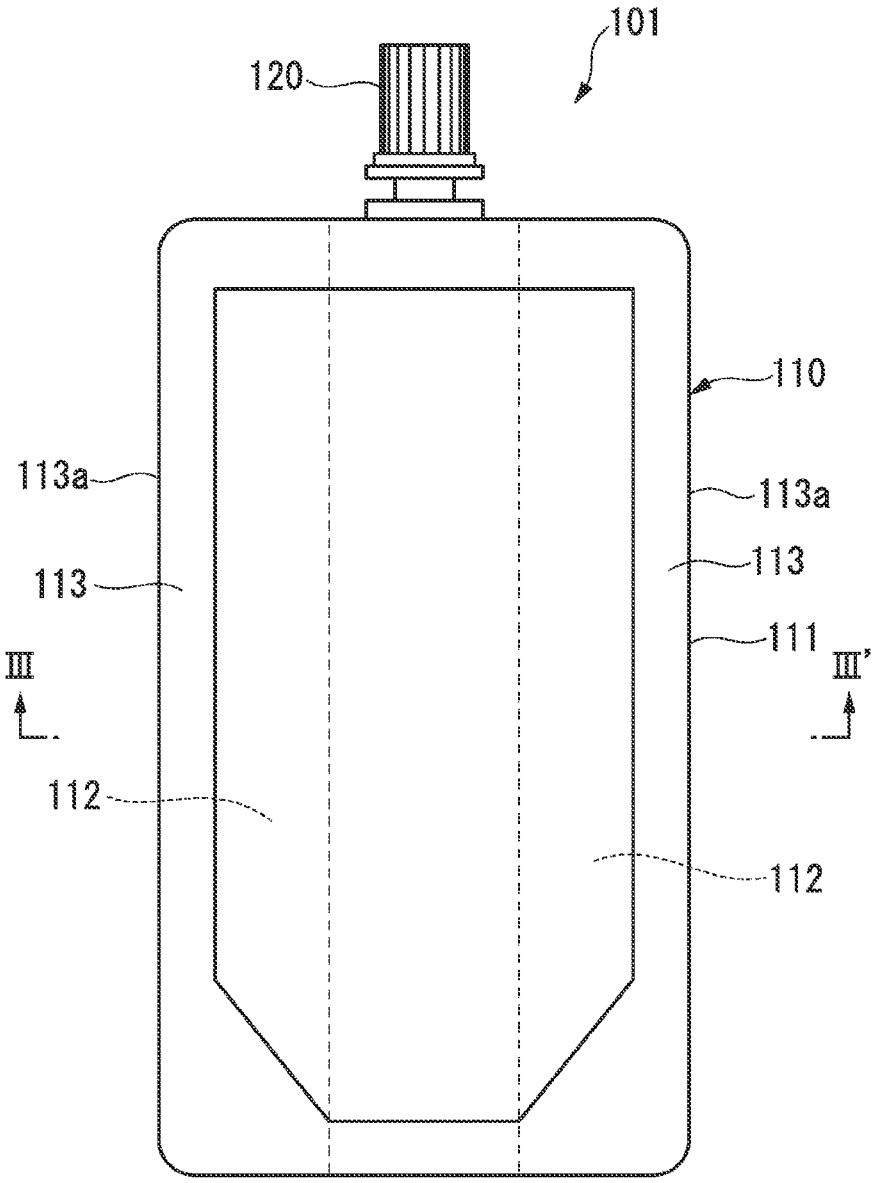
FIG. 21A is a front view showing an example of a conventional spout-attached gusset bag.
Figure 21B:
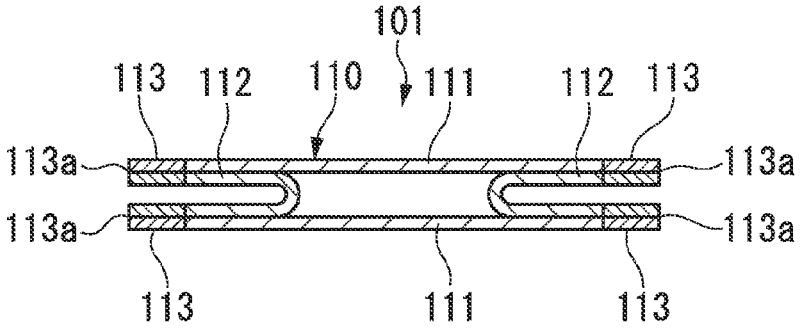
FIG. 21B is a cross-sectional view taken along the line III-III' of the spout-attached gusset bag of FIG. 21A.

Step (γ2):

The heat-sealing portion of the film members (C) 31A and (D) 32A is cut along the straight line P, that is, along the longitudinal direction at the center of the film member 32A in the direction perpendicular to the longitudinal direction to cut out a plurality of cylindrical film members having the flat surface portions 31, 31 and the side surface portions 32, 32 in which the four side edge sealing portions 33 are formed as shown in FIG. 20.

In addition, as in the case of manufacturing the spout-attached gusset bag 1, a part of the folded-back portion 33*c* is removed so that the folded-back portion 33*c* does not remain in a portion corresponding to the upper sealing portion 34 of the spout-attached gusset bag 2.

Step (γ3):

Each folded-back portion 33*c* of the side edge sealing portions 33 in the cylindrical film members obtained in the step (γ2) is folded back toward the side surface portion 32 along the unsealed portion 33*b* to adhesively fix the folded-back portion 33*c* by the adhesive applied to the adhesion portion 33*d*.

Step (γ4):

As in the case of manufacturing the spout-attached gusset bag 1, with regard to the cylindrical film member, the inner surfaces of the flat surface portions 31 and the inner surface of the side surface portions 32 at a portion to be the lower sealing portion 35 are heat-sealed to each other along the direction perpendicular to the longitudinal direction with a predetermined interval in the longitudinal direction, and the above portion is cut along the direction perpendicular to the longitudinal direction to be divided into a plurality of pieces in the longitudinal direction, whereby bag-shaped film members in which the lower sealing portion 35 is formed in the lower portions of the flat surface portions 31 and the side surface portions 32 are obtained.

Next, in the upper portions of the flat surface portions 31 and the side surface portions 32 of the bag-shaped film member as one of the plurality of pieces into which the cylindrical film member is divided, the sealing of the inner surfaces of the flat surface portions 31 and the contact portions of the flat surface portion 31 and the side surface portion 32, and the attachment of the spout 20 are performed by heat-sealing. Furthermore, the outer surfaces of the side surface portions 32 are sealed together to form the upper sealing portion 34. Examples of a method of sealing the outer surfaces of the side surface portions 32 to each other in the upper sealing 34 include a method including: forming punch holes facing each other in the side surface portions 32 at the upper portions of the side edge sealing portions 33; and bringing the inner surfaces of the flat surface portions 31 into contact with each other in the punch holes to heat-seal the inner surfaces to each other as in the case of manufacturing the spout-attached gusset bag 1. In addition, a method of fixing the outer surfaces of the side surface portions 32 to each other by using an adhesive, a heat-sealable film or a double-sided adhesive tape may also be used.

The spout-attached gusset bag 2 can be obtained by the above-described steps.

The method of manufacturing the spout-attached gusset bag 2 is also not limited to the above-described method as in the case of manufacturing the spout-attached gusset bag 1.

Any of the operation in the step (β4), the operation of forming the lower sealing portion 35, the operation of cutting the cylindrical film member along the direction perpendicular to the longitudinal direction to be divided into a plurality of pieces in the longitudinal direction, and the operation of forming the upper sealing portion 34 and attaching the spout 20 may be performed first, or the operations may be performed at the same time. For example, after the cylindrical film member was cut along the direction perpendicular to the longitudinal direction to be divided into a plurality of pieces in the longitudinal direction, the lower portions of the divided cylindrical film members may be sealed and the upper portions thereof may be sealed with the attached spout.

In addition, the operation of folding back and adhesively fixing the folded back portion 33*c* of the side edge sealing portion 33 in the step (β3) is not limited to being before the step (β4). For example, after the cylindrical film member was cut along the direction perpendicular to the longitudinal direction to be divided into a plurality of pieces in the longitudinal direction, the folded-back portions 33*c* of the side edge sealing portions 33 of the divided cylindrical film members may be folded back and adhesively fixed. In addition, in accordance with the used material of the film member, the side edge sealing portion 13 may be fixed by heat-sealing without using the adhesive.

In addition, also in the case of manufacturing the spout-attached gusset bag 2, in the step (γ1), together with the film members (E) 31A and (F) 32A, the long film members center-folded along the longitudinal direction are preferably conveyed so as to be placed at both side ends of the two film members (E) 31A so that the fold lines thereof are directed to the inside, to heat-seal the side edge portions of the center-folded film members and the two film members (E) 31A. Accordingly, it is possible to make full use of both side ends of the film member (E) 31A in the manufacturing of the gusset bag. In forming of the heat-sealing of the side edge portions of the center-folded film members and the two film members (E) 31A, a sealing portion which is heat-sealed, an unsealed portion which is not heat-sealed, and a sealing portion which is heat-sealed are formed in this order, in the direction perpendicular to the longitudinal direction.

In the above-described spout-attached gusset bag 2, the folded-back portion 33*c* of the side edge sealing portion 33 in which the side edge portion of the flat surface portion 31 and the side edge portion of the side surface portion 32 are heat-sealed together is folded back toward the side surface portion 32 along the unsealed portion 33*b* and adhesively fixed. Accordingly, when the spout-attached gusset bag 2 is squeezed by one's hand, the round unsealed portion 33*b* which is not heat-sealed and has low rigidity touches the hand. Therefore, it is possible to push out the contents by squeezing the spout-attached gusset bag 2 while causing the hand to feel little pain.

The spout-attached gusset bag of this embodiment is not limited to the above-described spout-attached gusset member 2. For example, the folded-back portion 33*c* may be folded back toward the flat surface portion 11 and adhesively fixed. In addition, in the four side edge sealing portions 33, the side edge sealing portions in which the folded-back portion 33*c* is folded back toward the flat surface portion 11 and the side edge sealing portions in which the folded-back portion 33*c* is folded back toward the side surface portion 12 may be used in combination.

In addition, the number of the side edge sealing portions 33 is not limited to four, and may be less than four. For example, a film member in which one side surface portion is formed integrally with a pair of flat surface portions facing each other may be used to form the side edge sealing portions 33 by heat-sealing only in the side of the other side surface portion, and the folded-back portion 33*c* may be folded back along the unsealed portion 33*b* and adhesively fixed.

In addition, when a film member in which the flat surface portion 31 and the side surface portion 32 are formed integrally with each other at any portion is used, the side edge sealing portion 33 may be formed by heat-sealing a portion corresponding to the side edge portion of the flat surface portion 31 and a portion corresponding to the side edge portion of the side surface portion 32 to each other, and the folded-back portion 33*c* of the side edge sealing portion 33 may be folded back toward the flat surface portion 31 or the side surface portion 32 along the unsealed portion 33*b*, and adhesively fixed. Accordingly, it is possible to prevent one's hand from feeling pain when the gusset bag is squeezed and improve the self-standing property of the gusset bag by forming the side edge sealing portion to be a support.

In addition, the spout-attached gusset bag of the invention may be a spout-attached gusset bag having a gusset bag in which the folding-back of the side edge sealing portion described in the first embodiment and the folding-back of the side edge sealing portion described in the second embodiment are used in combination.

In addition, the gusset bag of the invention is a bag which is the same as the above-described spout-attached gusset bag, except that the gusset bag of the invention has no spout. In this gusset bag, a notch or a cutoff line to open the bag may be formed.

INDUSTRIAL APPLICABILITY

According to the invention, it is possible to provide a gusset bag which has an excellent self-standing property and causes one's hand to feel little pain even when squeezing the gusset bag, and to provide a spout-attached gusset bag having the gusset bag with a spout attached thereto.

DESCRIPTION OF THE REFERENCE NUMERALS

1, 2: SPOUT-ATTACHED GUSSET BAG
10: GUSSET BAG
11: FLAT SURFACE PORTION
12: SIDE SURFACE PORTION
13: SIDE EDGE SEALING PORTION
13*a*: END PORTION OF SIDE EDGE SEALING PORTION
13*b*: FOLDED-BACK PORTION
13*c*: FOLDED LINE PORTION
14: UPPER SEALING PORTION
15: LOWER SEALING PORTION
20: SPOUT
30: GUSSET BAG
31: FLAT SURFACE PORTION
32: SIDE SURFACE PORTION
33: SIDE EDGE SEALING PORTION
33*a*: SEALING PORTION
33*b*: NONSEALING PORTION
33*c*: FOLDED-BACK PORTION
40: MANDREL

What is claimed is:

1. A gusset bag comprising:

a pair of flat surface portions facing each other; and a pair of side surface portions facing each other which are folded toward an inside thereof, wherein a containing portion to contain an object is formed using the pair of flat surface portions and the pair of side surface portions, wherein the gusset bag has a side edge sealing portion in which a flat surface portion and a side surface portion are heat-sealed together at side edge portions thereof, and a folded-back portion in which the entire side edge sealing portion is folded back and affixed to the flat surface portion which forms the containing portion, wherein lower portions of the pair of flat surface portions and of the pair of side surface portions are configured to form a bottom surface of the gusset bag by being bent toward the inside, wherein a first flat surface portion and the pair of side surface portions are formed of a first film member, and a second flat surface portion is formed of a second film member, wherein side edge portions of the side surface portions opposite to the first flat surface portion formed of the first film member and side edge portions of the second flat surface portion are heat-sealed together to form two side edge sealing portions, wherein the first flat surface portion is configured to be a front surface of the gusset bag, and the second flat surface portion is configured to be a rear surface of the gusset bag, wherein both surfaces of the second film member are capable of being heat-sealed, and the two side edge sealing portions are heat-sealed to the second flat surface portion which forms the containing portion, and wherein the front surface of the gusset bag does not have a side edge sealing portion.

2. The gusset bag according to claim 1, wherein the pair of flat surface portions and the pair of side surface portions have no folded-back portion at upper end portions thereof.

3. The gusset bag according to claim 1, wherein a folding line by folding back the entire side edge sealing portion is positioned in the flat surface portion and the side surface portion other than the side edge sealing portion.

4. The gusset bag according to claim 1, wherein a width of each lower portion of the first and second flat surface portions gradually decreases toward each lower end of the first and second flat surface portions.

5. The gusset bag according to claim 4, further comprising a lower sealing portion in which central parts in a width direction of lower edges of the first and second flat surface portions are affixed to each other, wherein the side surface portions folded toward the inside are positioned between the first and second flat surface portions at two sides in the width direction of the lower sealing portion in a lower portion of the gusset bag.

6. The gusset bag according to claim 1, wherein lower portions of the first and second flat surface portions are configured to form the bottom surface by the lower portions of the first and second flat surface portions being positioned below lower portions of the pair of side surface portions.

7. A spout-attached gusset bag, wherein a spout is attached to an opening portion of the gusset bag according to claim 1.

* * * * *